US010046568B2

(12) United States Patent
Shimomura

(10) Patent No.: US 10,046,568 B2
(45) Date of Patent: Aug. 14, 2018

(54) RECORDING APPARATUS

(71) Applicant: SEIKO EPSON CORPORATION, Tokyo (JP)

(72) Inventor: Masaki Shimomura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/398,493

(22) Filed: Jan. 4, 2017

(65) Prior Publication Data

US 2017/0203574 A1 Jul. 20, 2017

(30) Foreign Application Priority Data

Jan. 14, 2016 (JP) ..... 2016-005018

(51) Int. Cl.
*B41J 2/175* (2006.01)
*B41J 29/02* (2006.01)

(52) U.S. Cl.
CPC ..... *B41J 2/175* (2013.01); *B41J 2/17509* (2013.01); *B41J 2/17556* (2013.01); *B41J 29/02* (2013.01)

(58) Field of Classification Search
CPC ..... B41J 2/175; B41J 2/17509; B41J 2/16508
See application file for complete search history.

(56) References Cited

U.S. PATENT DOCUMENTS 5,439,442 A * 8/1995 Bellifemine ..... A61M 5/1689 604/65
2004/0125182 A1* 7/2004 Akermalm ..... B41J 2/17509 347/85
2005/0219281 A1* 10/2005 Seino ..... B41J 2/17523 347/6
2008/0309738 A1* 12/2008 Yan ..... B41J 2/175 347/85
2014/0043392 A1 2/2014 Suzuki et al.
2014/0098166 A1 4/2014 Suzuki et al.
2015/0258798 A1 9/2015 Miyamoto et al.

FOREIGN PATENT DOCUMENTS

| | | |
|---|---|---|
| JP | 2016-049660 | 4/2016 |
| JP | 2016-049769 | 4/2016 |
| WO | 2014-024390 | 2/2014 |
| WO | 2014-024391 | 2/2014 |
| WO | 2015-136868 | 9/2015 |
| WO | 2015-136914 | 9/2015 |

* cited by examiner

*Primary Examiner* — John P Zimmermann
(74) *Attorney, Agent, or Firm* — Workman Nydegger

(57) ABSTRACT

A recording apparatus includes a recording head that ejects liquid onto a recording medium, a liquid accommodating portion that accommodates the liquid, a relay portion that is provided on a flow path of the liquid between the liquid accommodating portion and the recording head and relays the liquid, a tube that forms at least a part of the flow path of the liquid between the liquid accommodating portion and the relay portion and is attachable and detachable with respect to the relay portion, and a holding portion that holds the tube in a state of being detached from the relay portion.

16 Claims, 19 Drawing Sheets

RECORDING APPARATUS

CROSS REFERENCES TO RELATED APPLICATIONS

The entire disclosure of Japanese Patent Application No. 2016-005018, filed Jan. 14, 2016 is expressly incorporated by reference herein.

BACKGROUND

1. Technical Field

The present invention relates to a recording apparatus that performs recording on a recording medium.

2. Related Art

An ink jet printer will be described below as an example of the recording apparatus. In the manner indicated in International Publication WO2015/136914, in the ink jet printer, a liquid accommodating unit is provided outside of an apparatus main body, and it is possible to increase the amount of ink that it is possible to accommodate. The liquid accommodating unit that is provided outside of the apparatus main body and a carriage are connected by an ink supply tube.

When maintenance work or repair work of the apparatus main body is performed, an ink supply tube may be detached from a predetermined connection site.

However, there is a risk that when the detached ink supply tube is left in a state in which an opening end hangs down, ink leaks out from the opening end.

Therefore, in the related art, an operator fixes the detached ink supply tube using, for example, an adhesive tape and the like at an appropriate position, but workability may be bad and the detached ink supply tube may easily come off. In particular, there is a risk that peeling easily occurs due to a manner of sticking or a state of a sticking surface of the adhesive tape (presence of concavities and convexities, adhesion of oil, dust, and the like, and the like).

SUMMARY

An advantage of some aspects of the invention is to provide a recording apparatus with superior handling of an ink supply tube.

According to an aspect of the invention, there is provided a recording apparatus including a recording head that ejects liquid onto a recording medium, a liquid accommodating portion that accommodates the liquid, a relay portion that is provided on a flow path of the liquid between the liquid accommodating portion and the recording head and relays the liquid, a tube that forms at least a part of the flow path of the liquid between the liquid accommodating portion and the relay portion and is attachable and detachable with respect to the relay portion, and a holding portion that holds the tube in a state of being detached from the relay portion.

According to the aspect, since the recording apparatus is provided with the relay portion that is provided on the flow path of the liquid between the liquid accommodating portion and the recording head and relays the liquid, and is provided with the holding portion that holds the tube in a state of being detached from the relay portion, it is possible to hold the tube that is detached from the relay portion with easy workability.

According to another aspect of the invention, there is provided a recording apparatus including a recording head that ejects liquid onto a recording medium, a liquid accommodating portion that accommodates the liquid, a tube that forms at least a part of a flow path of the liquid between the liquid accommodating portion and the recording head and is attachable and detachable with respect to the liquid accommodating portion, and a holding portion that holds the tube in a state of being detached from the liquid accommodating portion.

According to the aspect, since the recording apparatus is provided with the holding portion that holds the tube in a state of being detached from the liquid accommodating portion that accommodates liquid, it is possible to hold the tube that is detached from the liquid accommodating portion with easy workability.

According to still another aspect of the invention, there is provided a recording apparatus including a unit body that is provided with a recording head that ejects liquid onto a recording medium, a liquid accommodating portion that accommodates the liquid, a tube that forms at least a part of a flow path of the liquid between the liquid accommodating portion and the recording head and is attachable and detachable with respect to the unit body, and a holding portion that holds the tube in a state of being detached from the unit body.

According to the aspect, since the recording apparatus is provided with the unit body that is provided with the recording head that ejects liquid onto the recording medium, and is provided with the holding portion that holds the tube in a state of being detached from the unit body, it is possible to hold the tube that is detached from the unit body with easy workability.

In the recording apparatus, the holding portion holds the tube in a state in which an opening of the tube is upward.

According to the aspect, since the holding portion holds the tube in the state in which the opening of the tube is upward, it is possible to more reliably prevent leakage of the liquid from the opening of the tube.

In the recording apparatus, the liquid accommodating portion and the tube are provided for each liquid of a plurality of colors, and the holding portion is configured to hold each of the plurality of tubes.

According to the aspect, since the liquid accommodating portion and the tube are provided for each liquid of a plurality of colors, and the holding portion is configured to hold each of the plurality of tubes, operation for holding the tube in the holding portion is easy in comparison with the configuration in which the plurality of tubes are held together, it is possible to hold only an arbitrary tube, and the degree of freedom of maintenance work or repair work of the recording apparatus improves.

In the recording apparatus, an opening end of the tube is configured by an attachable and detachable adapter that has a flange portion which is larger than a diameter of the tube, and the holding portion is configured to lock the attachable and detachable adapter using the flange portion.

According to the aspect, since the opening end of the tube is configured by the attachable and detachable adapter that has the flange portion which is larger than the diameter of the tube, and the holding portion is configured to lock the attachable and detachable adapter using the flange portion, the structure of the holding portion is simple and it is possible to reliably hold the tube.

In the recording apparatus, the holding portion is configured by one-touch clamps.

According to the aspect, since the holding portion is configured by the one-touch clamps, it is possible to hold the tube with the holding portion with easier workability.

In the recording apparatus, the relay portion is configured to be attachable and detachable, and in a state in which the holding portion holds the tube, the holding portion and the tube are positioned at a location which is apart from an attachment and detachment region of the relay portion.

According to the aspect, since the relay portion is configured to be attachable and detachable, and in a state in which the holding portion holds the tube, the holding portion and the tube are positioned at the location which is apart from the attachment and detachment region of the relay portion, it is possible to attach and detach the relay portion with easy workability without the holding portion and the tube being obstacles during the attachment and detachment work of the relay portion.

In the recording apparatus, the relay portion is provided with a check valve that stops leakage of the liquid from a connecting portion to which the tube is connected.

According to the aspect, it is possible to prevent leakage of liquid from the connecting portion when the tube is detached from the relay portion.

The recording apparatus may further include, a storage portion that stores the liquid accommodating portion, in which the holding portion is provided inside the storage portion.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
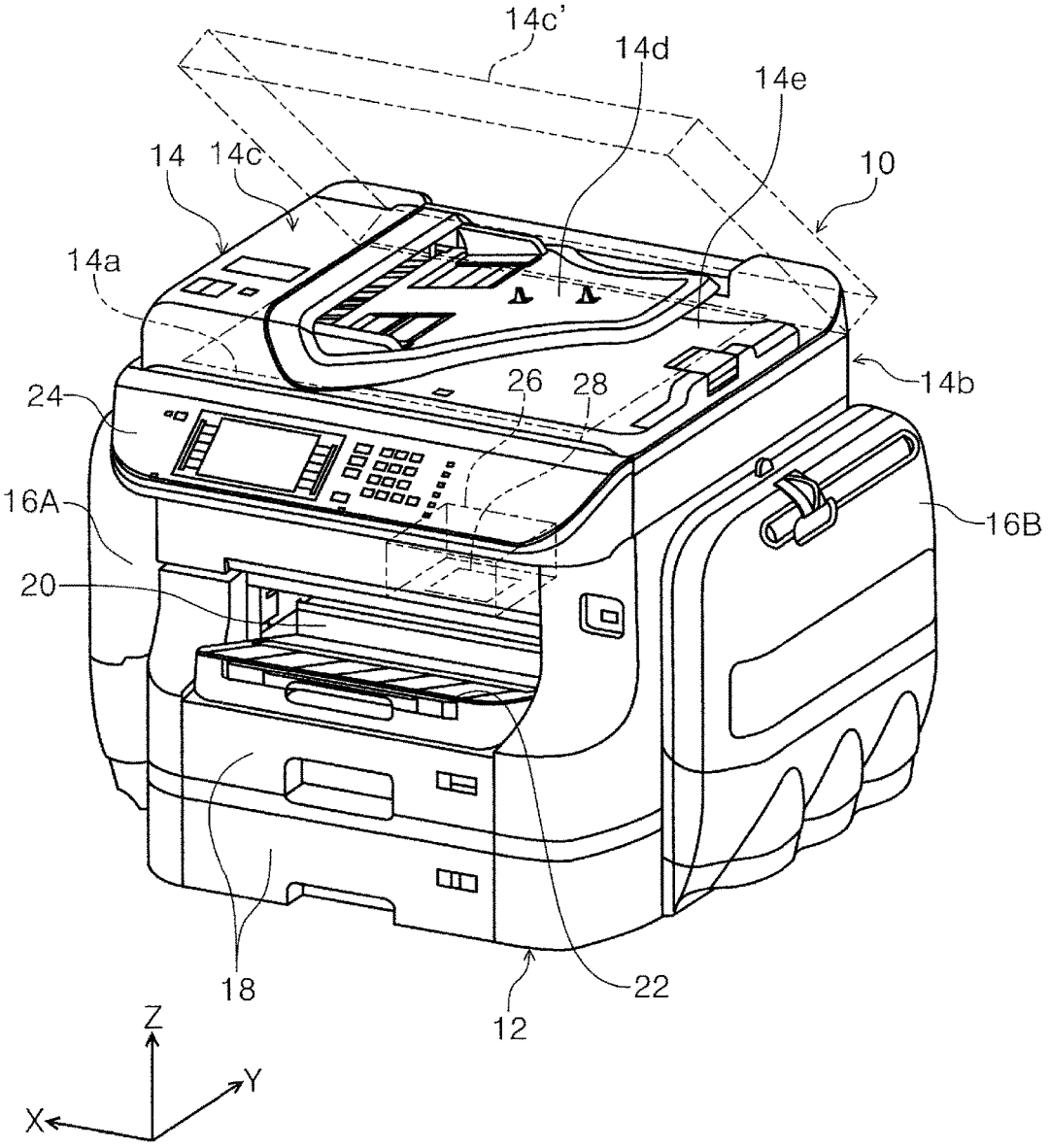
FIG. 1 is an outer appearance perspective view illustrating a printer according to the invention.

Embodiments of the present invention will be described below with reference to the drawings. Note that, where the configuration is the same in the respective embodiments, the same reference numerals are given, only the first example is described, and description is omitted for configurations in subsequent examples.

Figure 2:
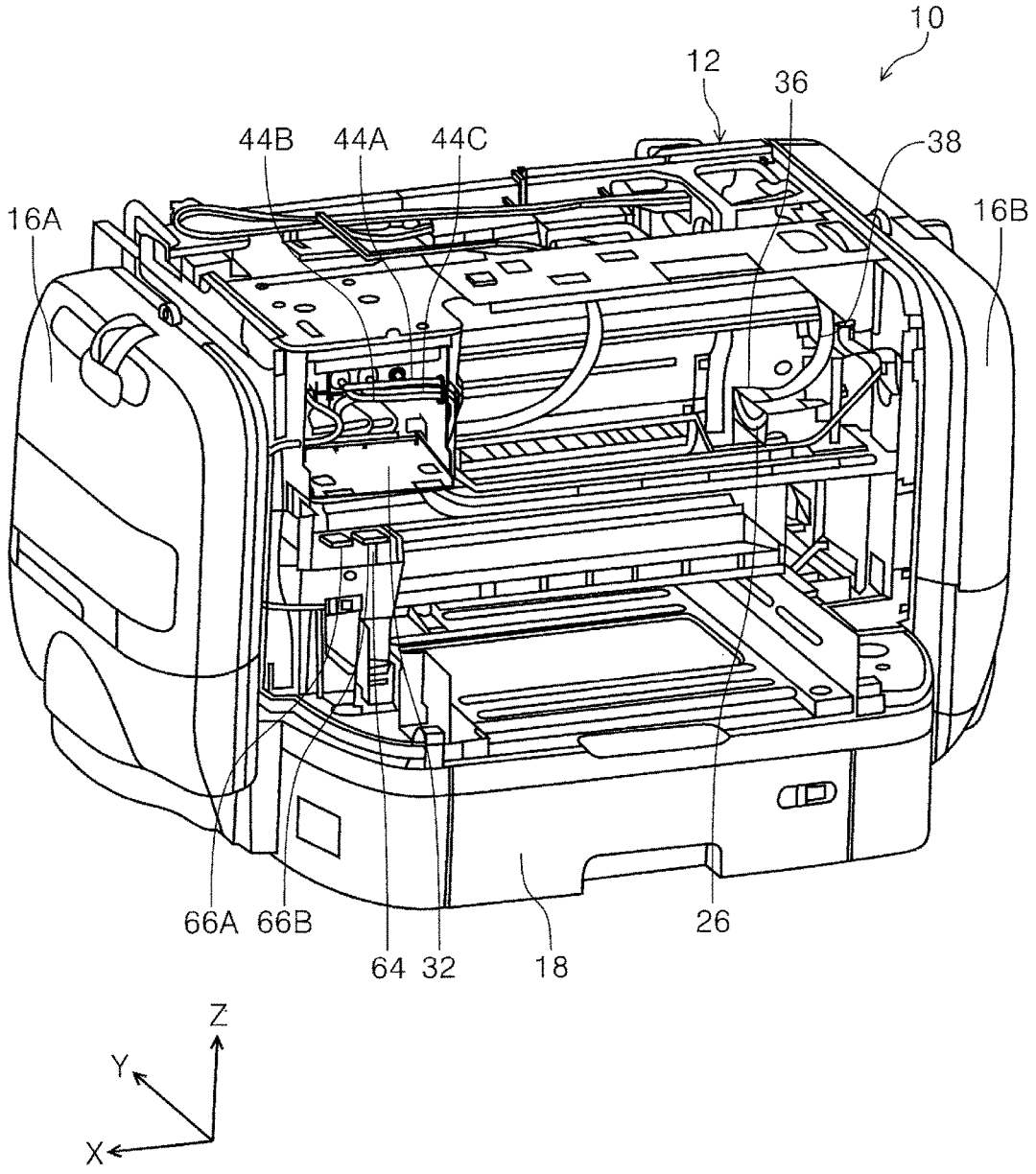
FIG. 2 is a perspective view illustrating a state in which a partial external member is detached in a recording mechanism portion in the printer.
Figure 3:
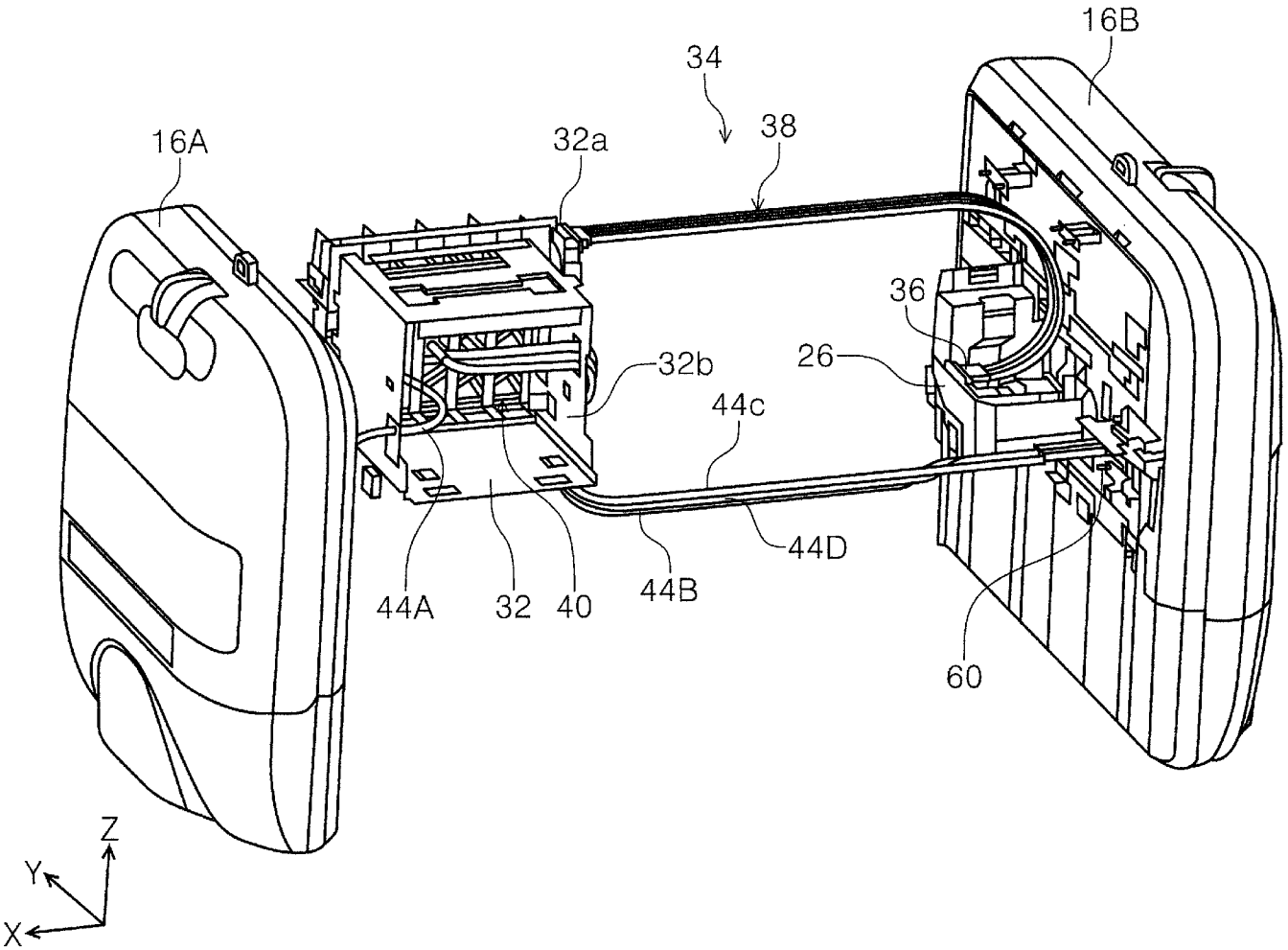
FIG. 3 is a perspective view illustrating a relationship between a carriage, a relay portion, and an ink accommodating body storage portion.
Figure 4:
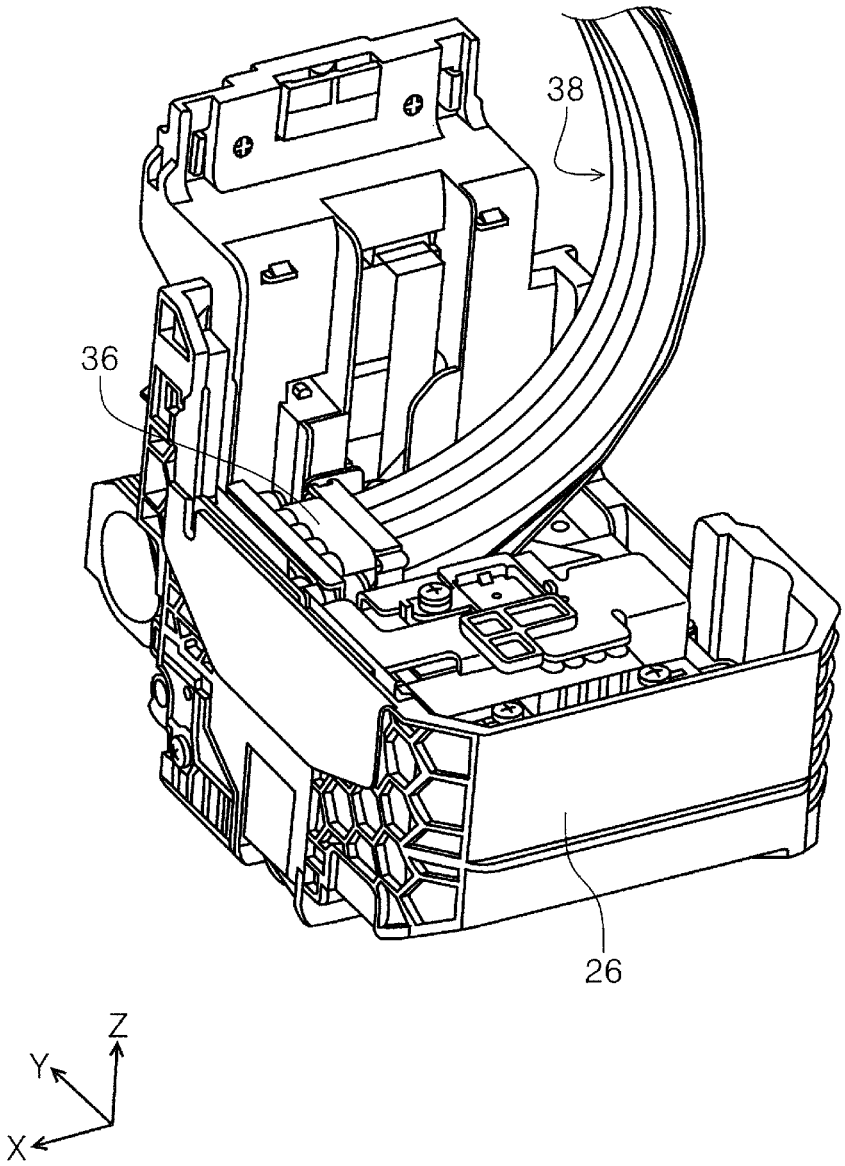
FIG. 4 is a perspective view of the carriage according to the invention.
Figure 5:
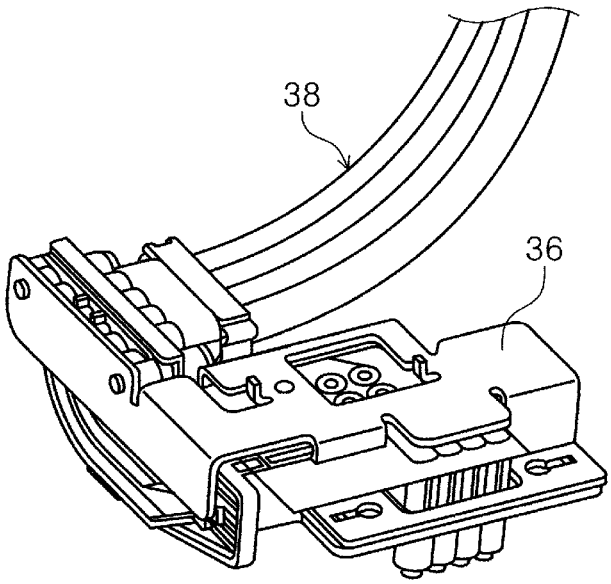
FIG. 5 is a perspective view of an ink tube connecting portion that is connected to the carriage.
Figure 5:
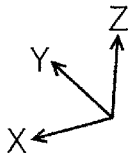
Figure 6:
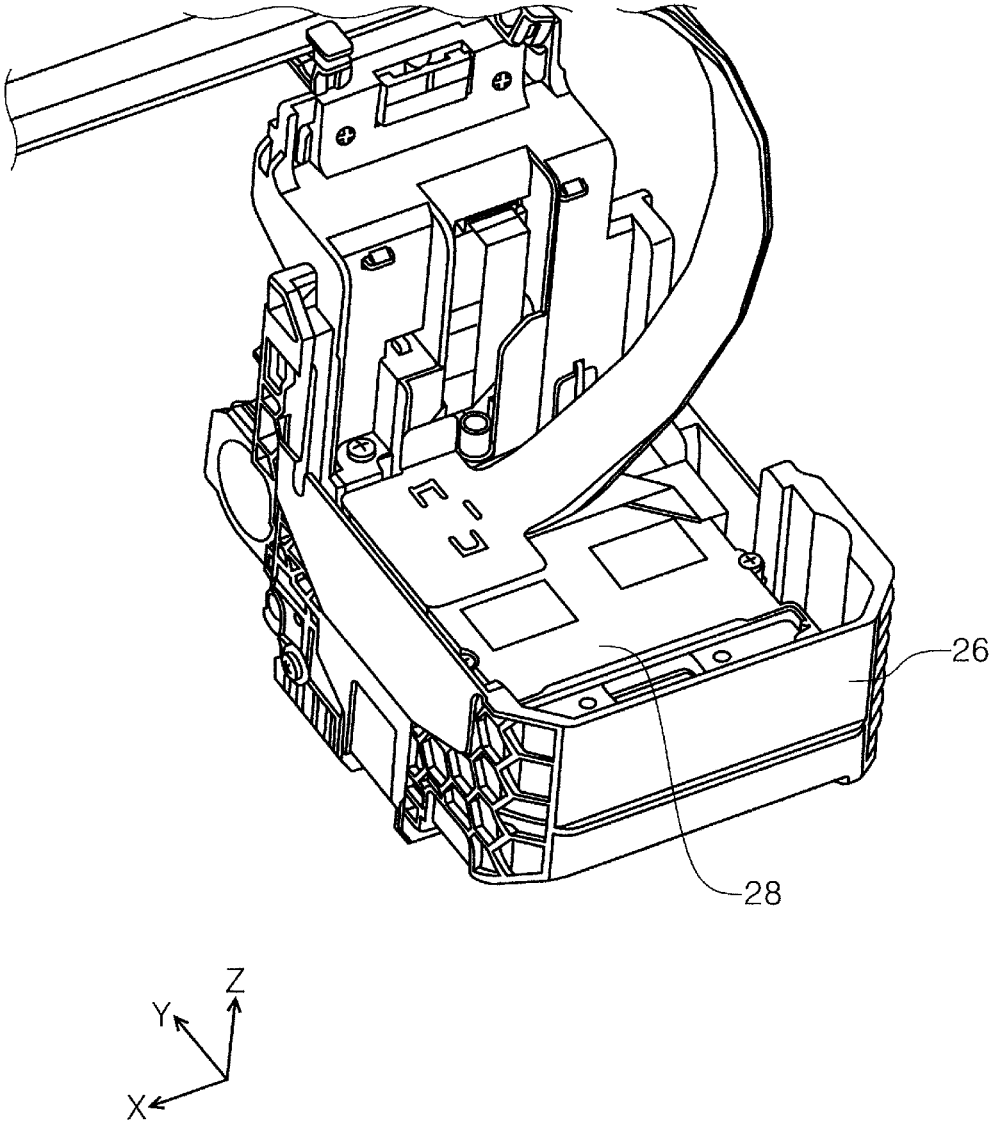
FIG. 6 is a perspective view of the carriage in a state in which the ink tube connecting portion is detached.

FIG. 1 is an outer appearance perspective view illustrating a printer according to the invention, FIG. 2 is a perspective view illustrating a state in which a partial external member is detached in a recording mechanism portion in the printer, FIG. 3 is a perspective view illustrating a relationship between a carriage, a relay portion, and an ink accommodating body storage portion, FIG. 4 is a perspective view of the carriage according to the invention, FIG. 5 is a perspective view of an ink tube connecting portion that is connected to the carriage, and FIG. 6 is a perspective view of the carriage in a state in which the ink tube connecting portion is detached.

Figure 7:
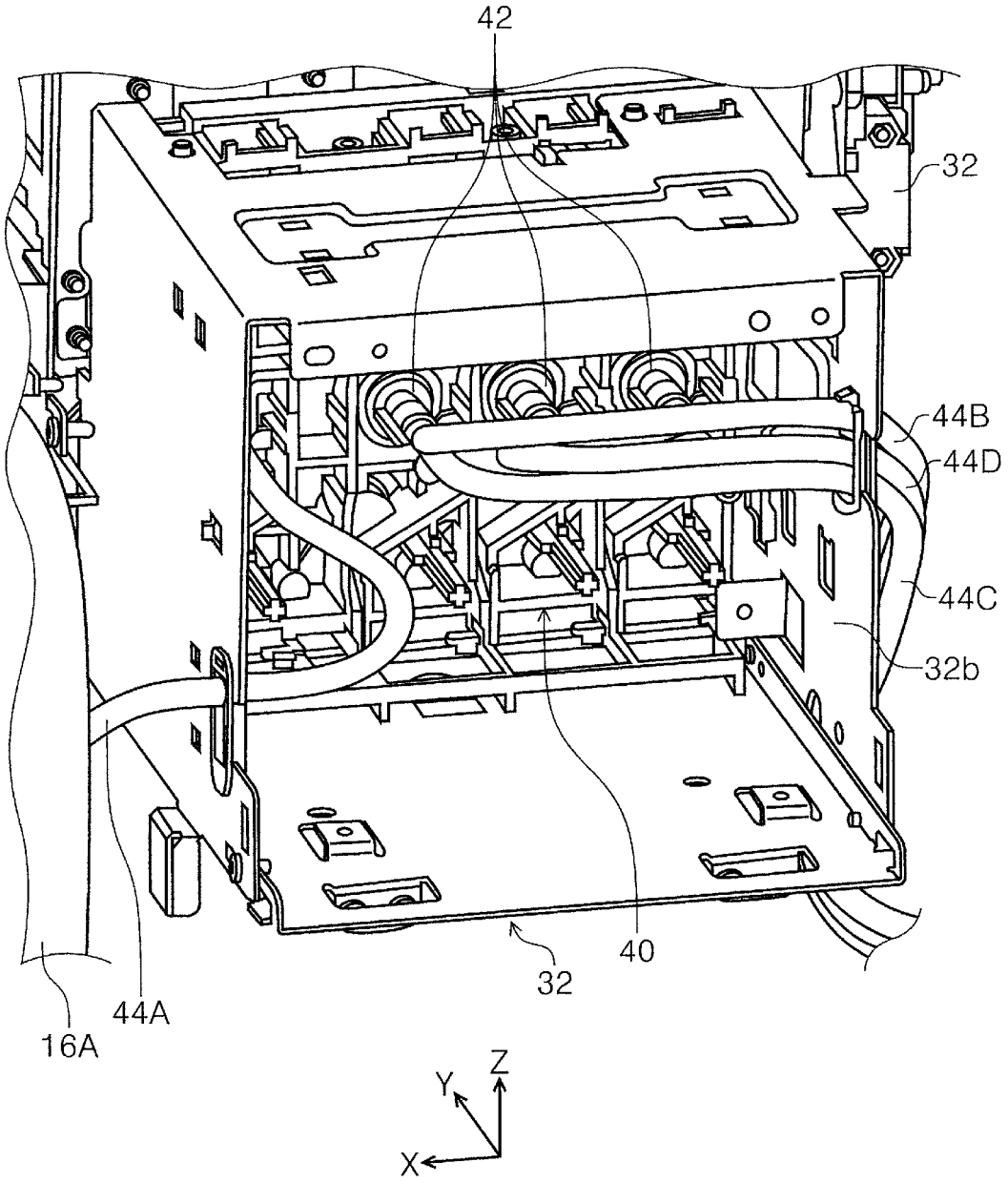
FIG. 7 is a perspective view of the relay portion that is provided between the carriage and an ink accommodating body according to the invention.
Figure 8:
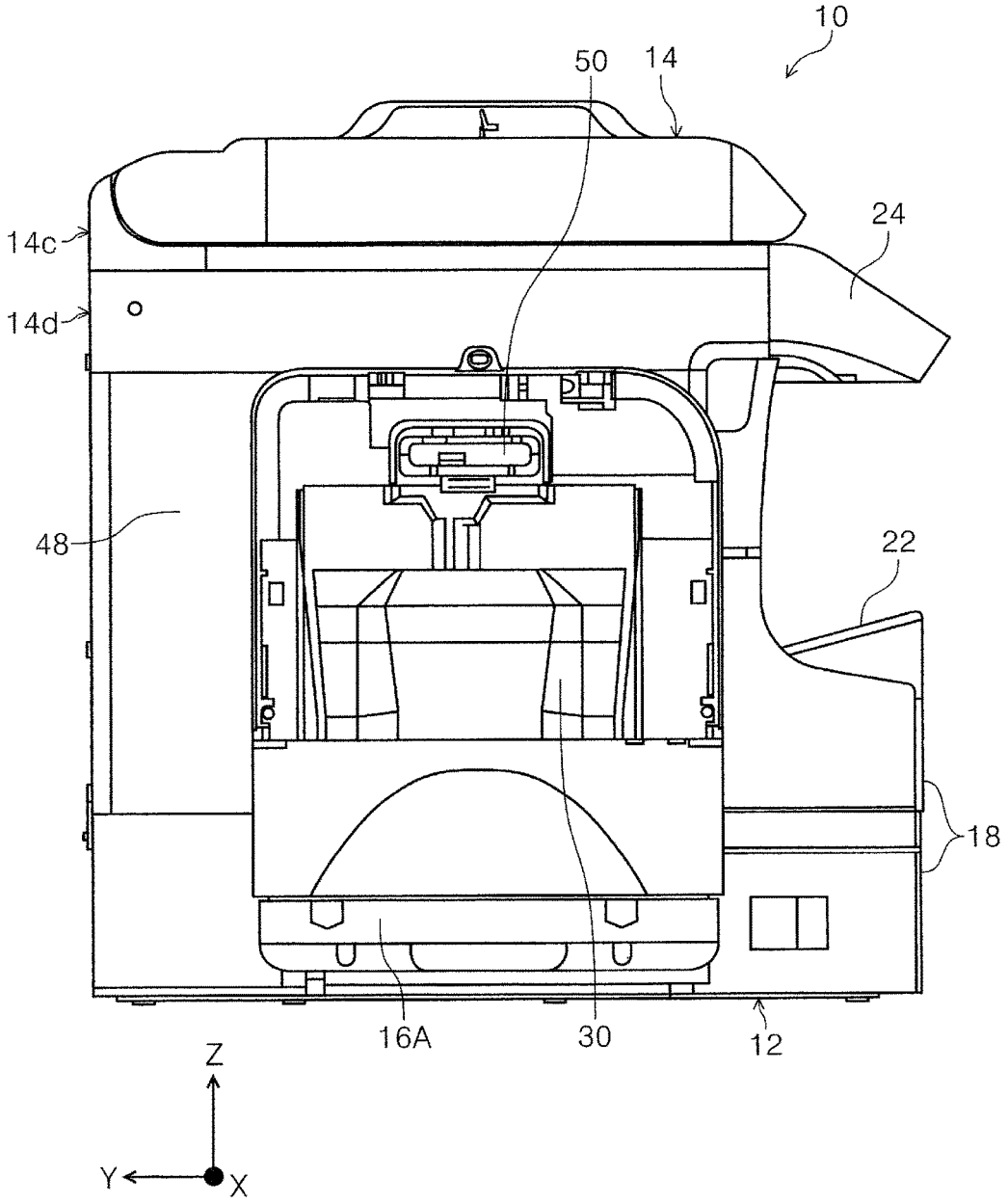
FIG. 8 is a side view illustrating the ink accommodating body that is stored in the ink accommodating body storage portion which is provided on an apparatus left side surface.
Figure 9:
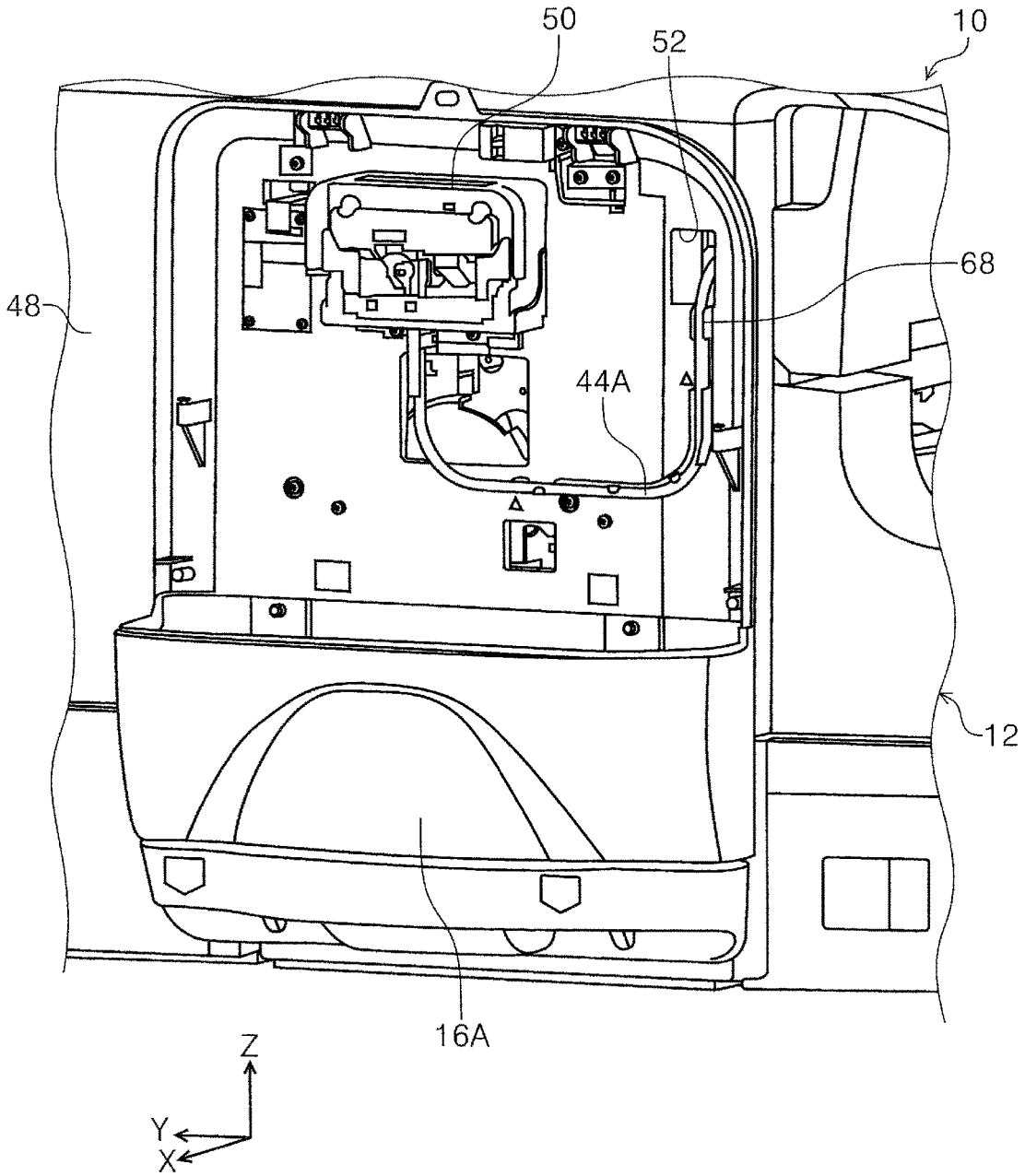
FIG. 9 is a perspective view illustrating a state in which the ink accommodating body is detached from the ink accommodating body storage portion that is provided on the apparatus left side surface.
Figure 10:
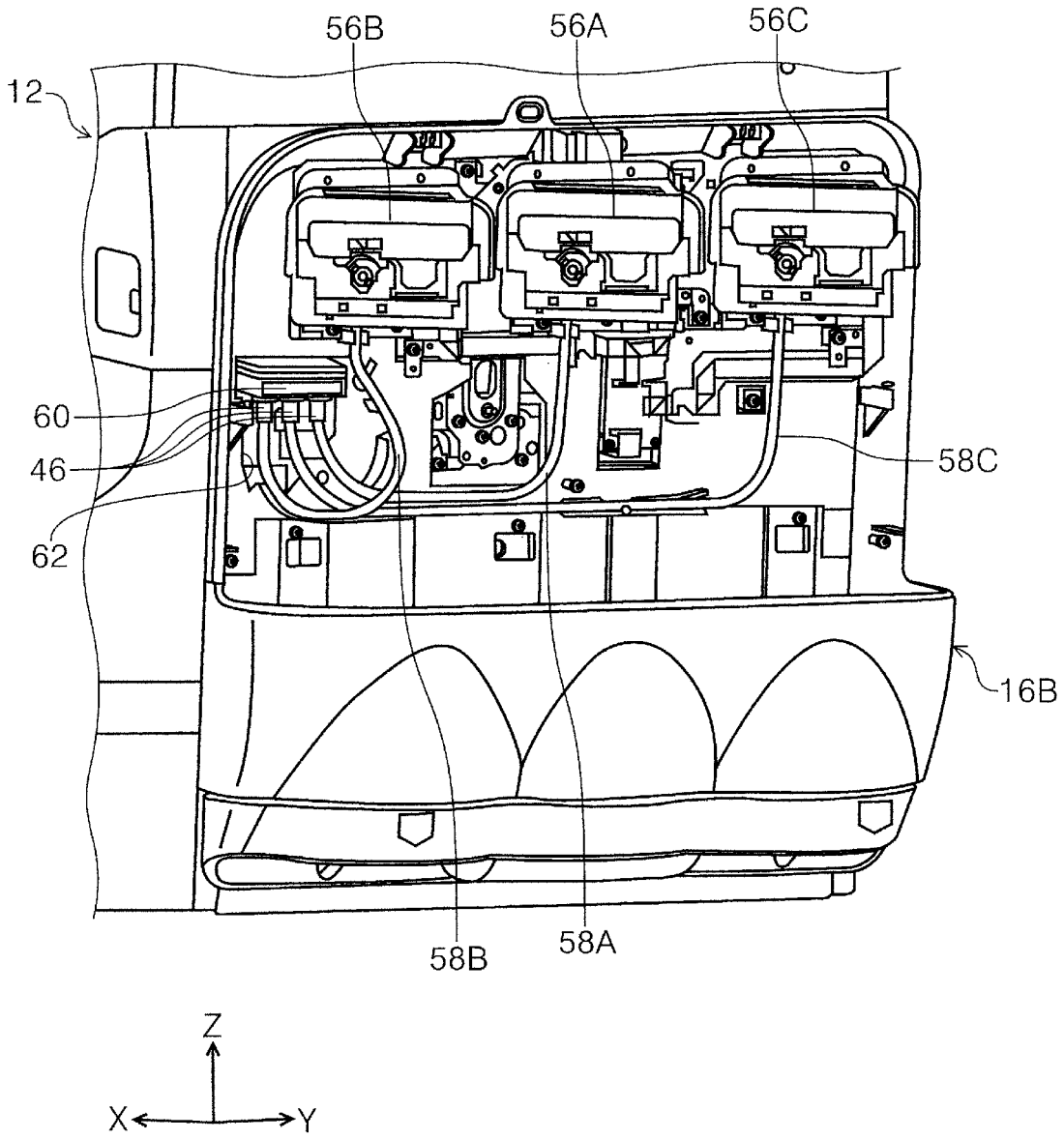
FIG. 10 is a perspective view illustrating a state in which the ink accommodating body is detached from the ink accommodating body storage portion that is provided on an apparatus right side surface.
Figure 11:
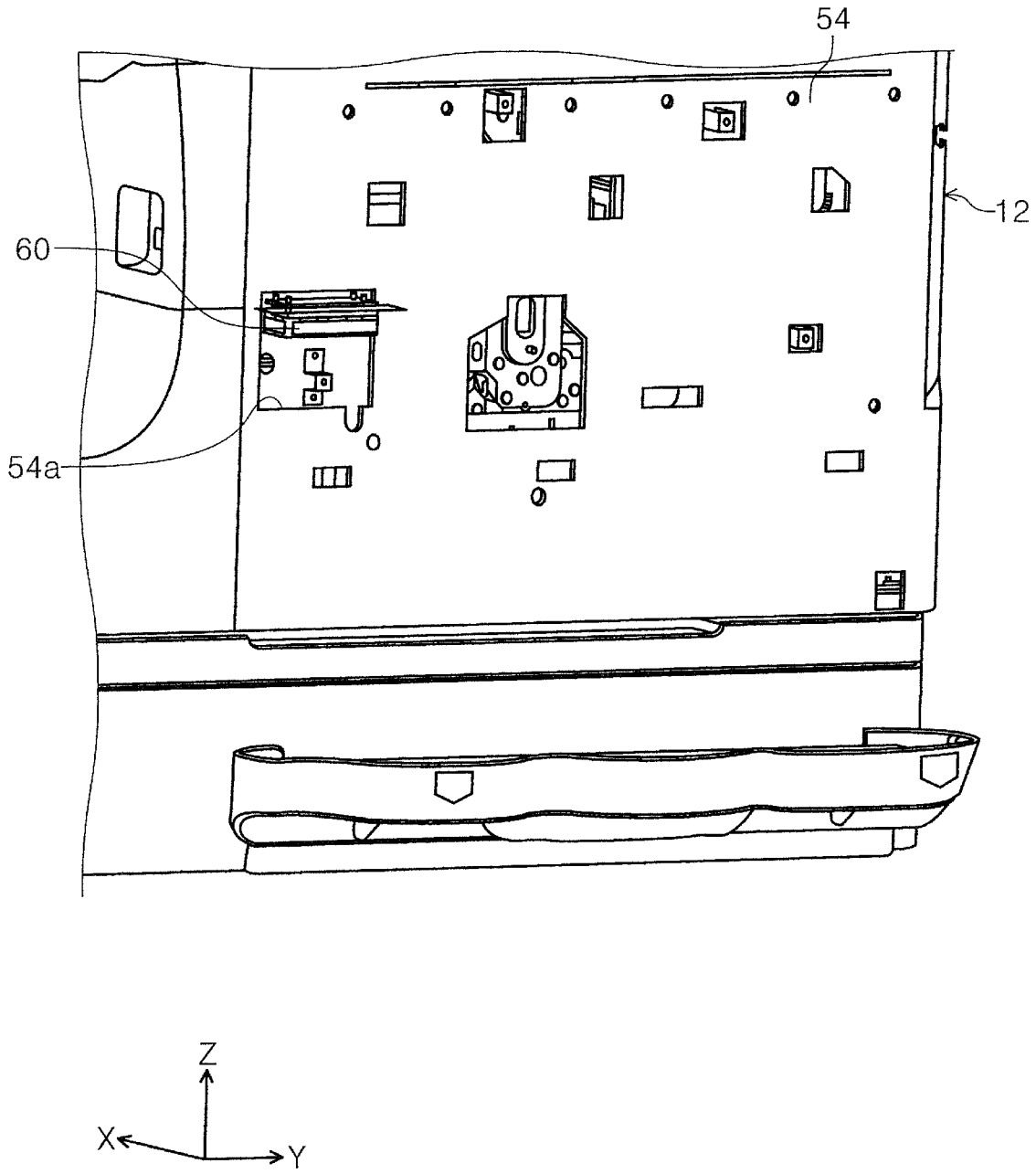
FIG. 11 is a perspective view illustrating a state in which the ink accommodating body storage portion that is provided on the apparatus right side surface is detached from the apparatus.
Figure 12:
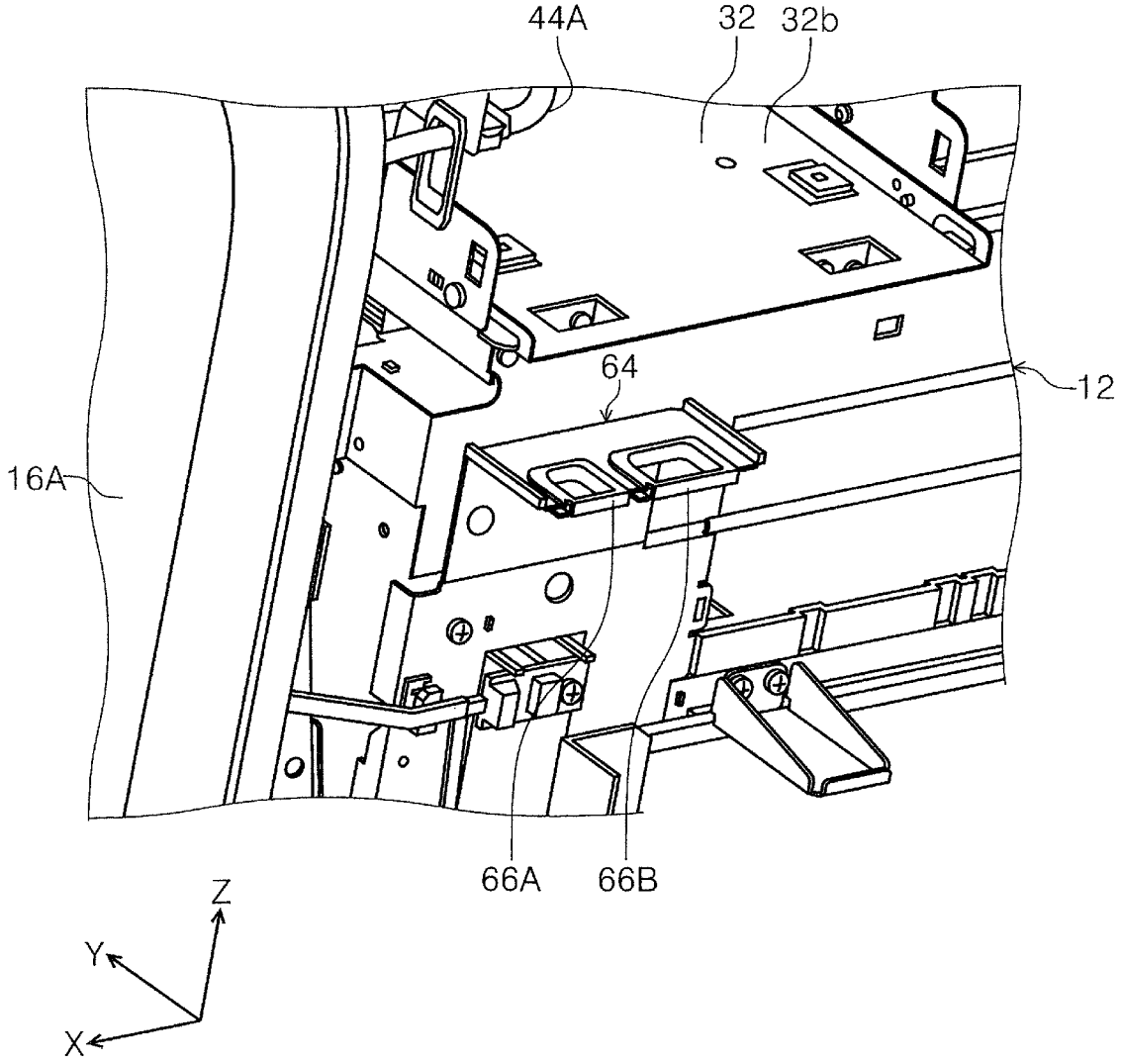
FIG. 12 is a perspective view of a holding portion that holds an ink tube which is detached from the relay portion.

In addition, FIG. 7 is a perspective view of the relay portion that is provided between the carriage and an ink accommodating body according to the invention, FIG. 8 is a side view illustrating the ink accommodating body that is stored in the ink accommodating body storage portion which is provided on an apparatus left side surface, FIG. 9 is a perspective view illustrating a state in which the ink accommodating body is detached from the ink accommodating body storage portion which is provided on the apparatus left side surface, FIG. 10 is a perspective view illustrating a state in which the ink accommodating body is detached from the ink accommodating body storage portion which is provided on an apparatus right side surface, FIG. 11 is a perspective view illustrating a state in which the ink accommodating body storage portion which is provided on the apparatus right side surface is detached from the apparatus, and FIG. 12 is a perspective view of a holding portion that holds an ink tube which is detached from the relay portion.

Figure 13:
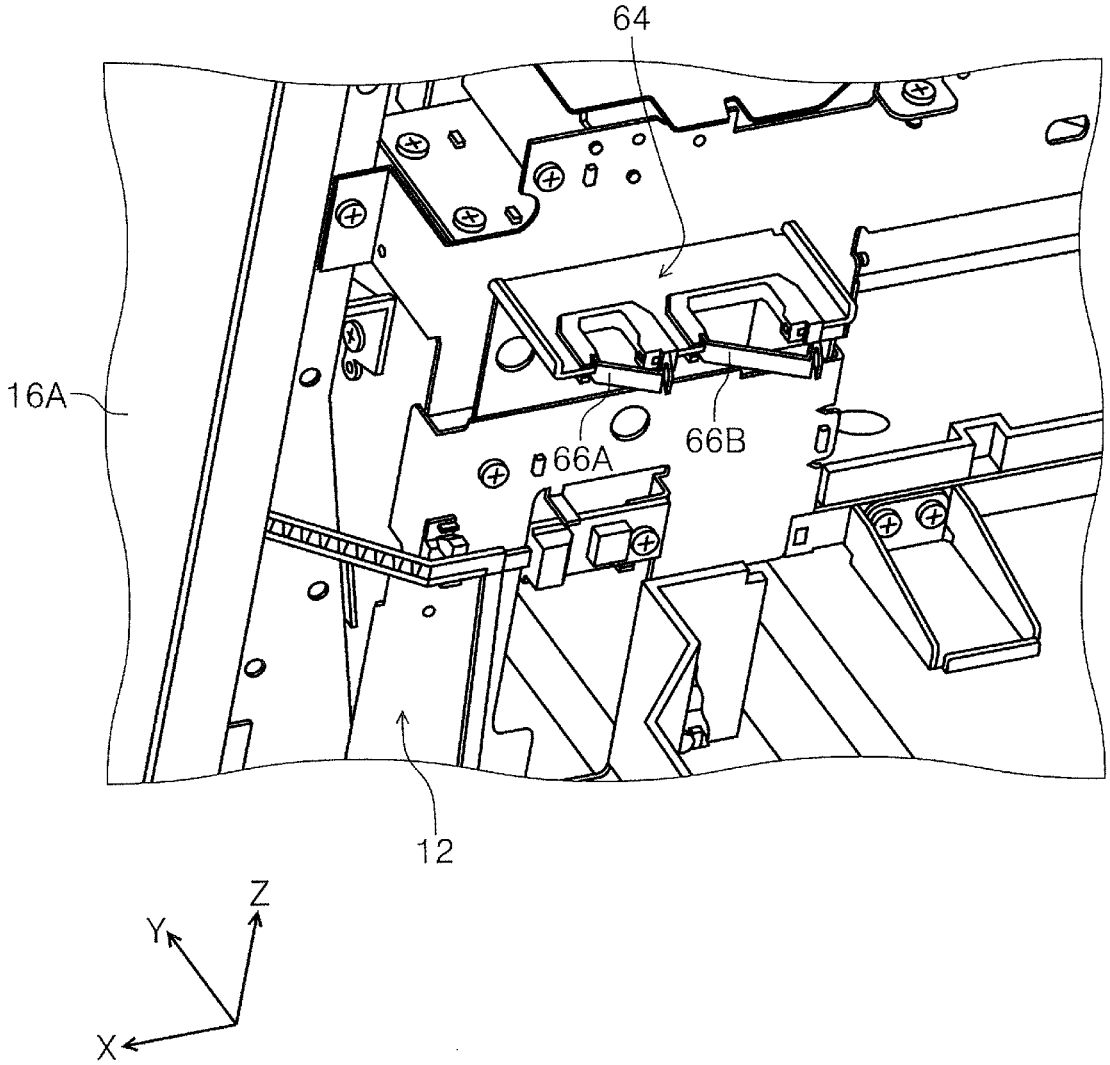
FIG. 13 is a perspective view of a state in which one-touch clamps that are provided in the holding portion are open.
Figure 14:
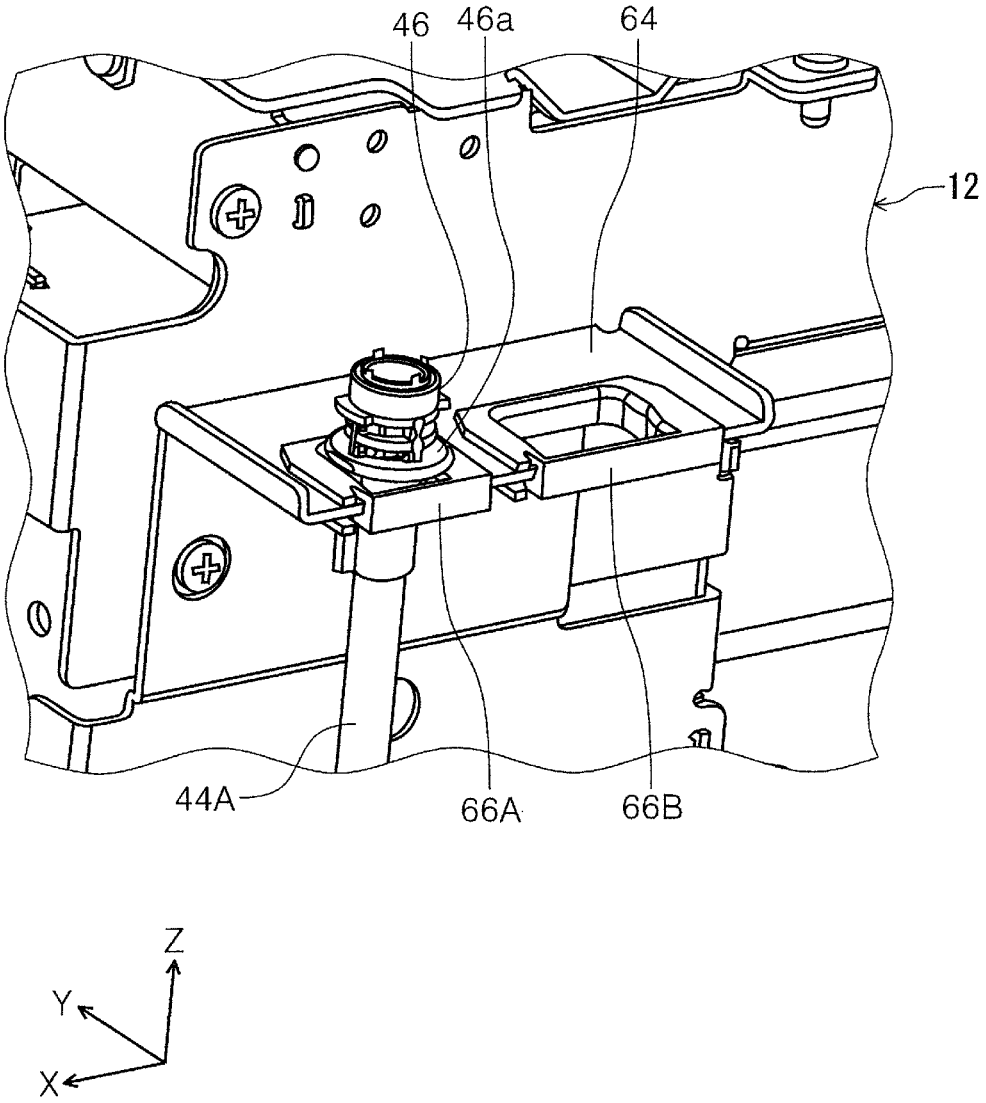
FIG. 14 is a perspective view illustrating a state in which the ink tube is held in the holding portion.
Figure 15:
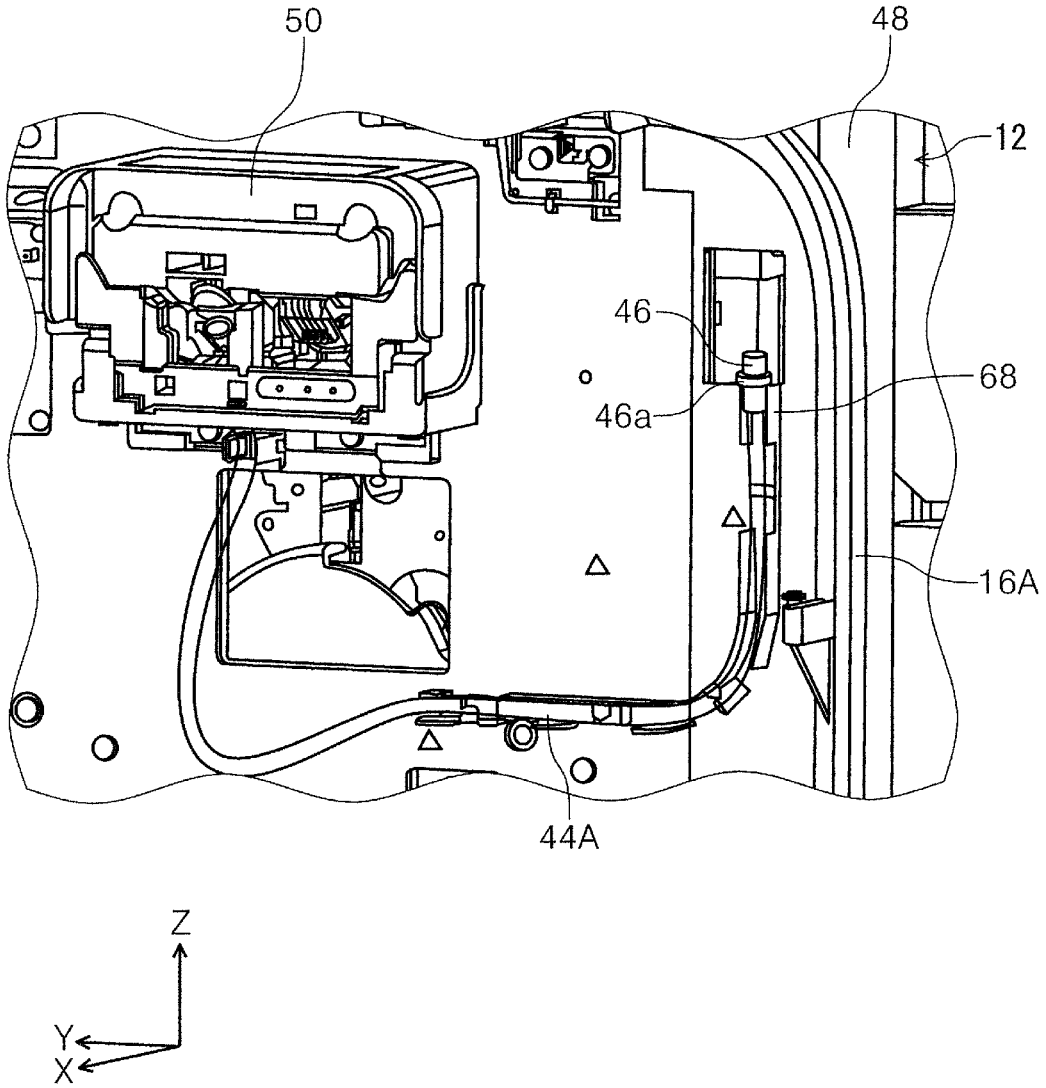
FIG. 15 is a perspective view illustrating a state in which the ink tube is held in the ink accommodating body storage portion.
Figure 16:
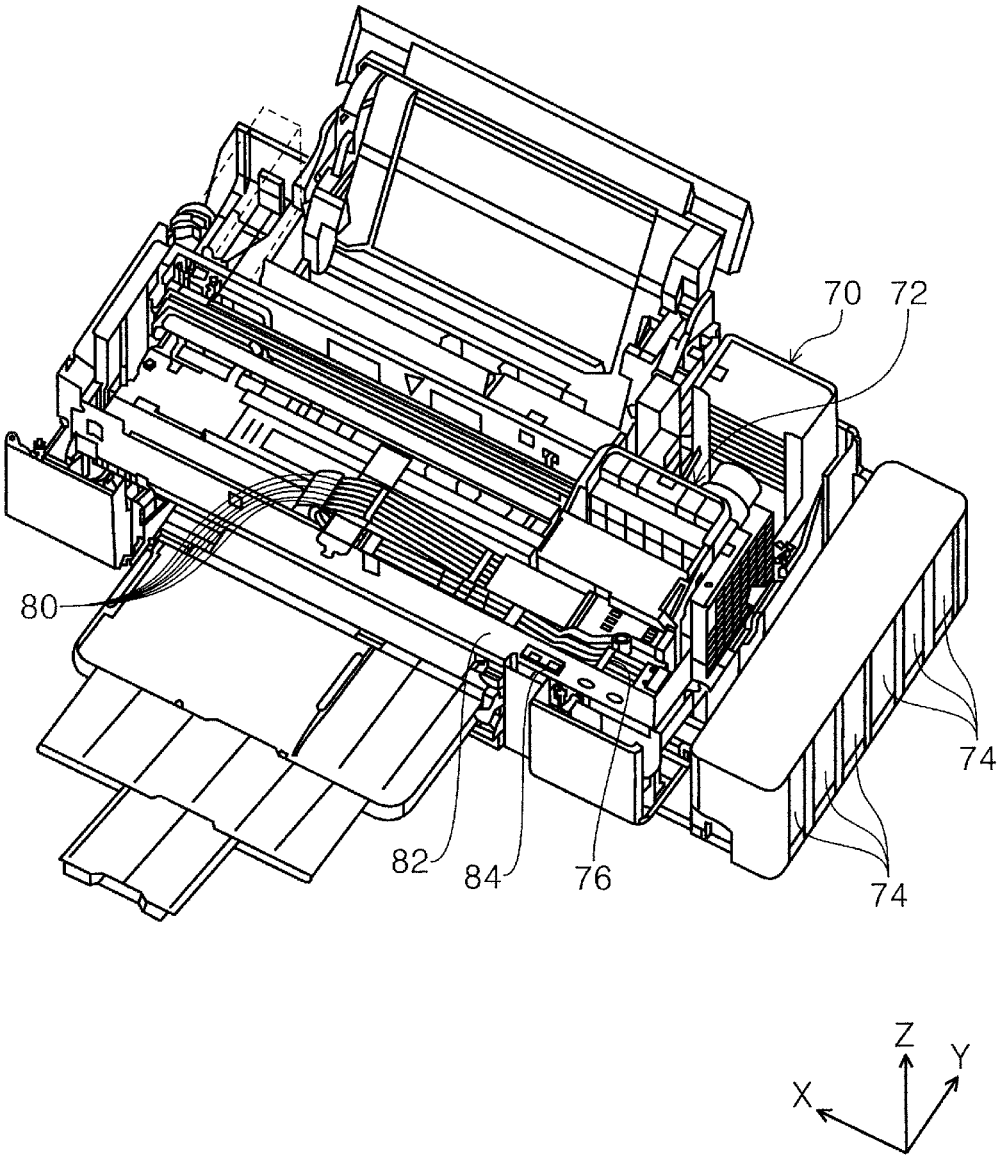
FIG. 16 is a perspective view illustrating a holding portion in a second example.
Figure 17:
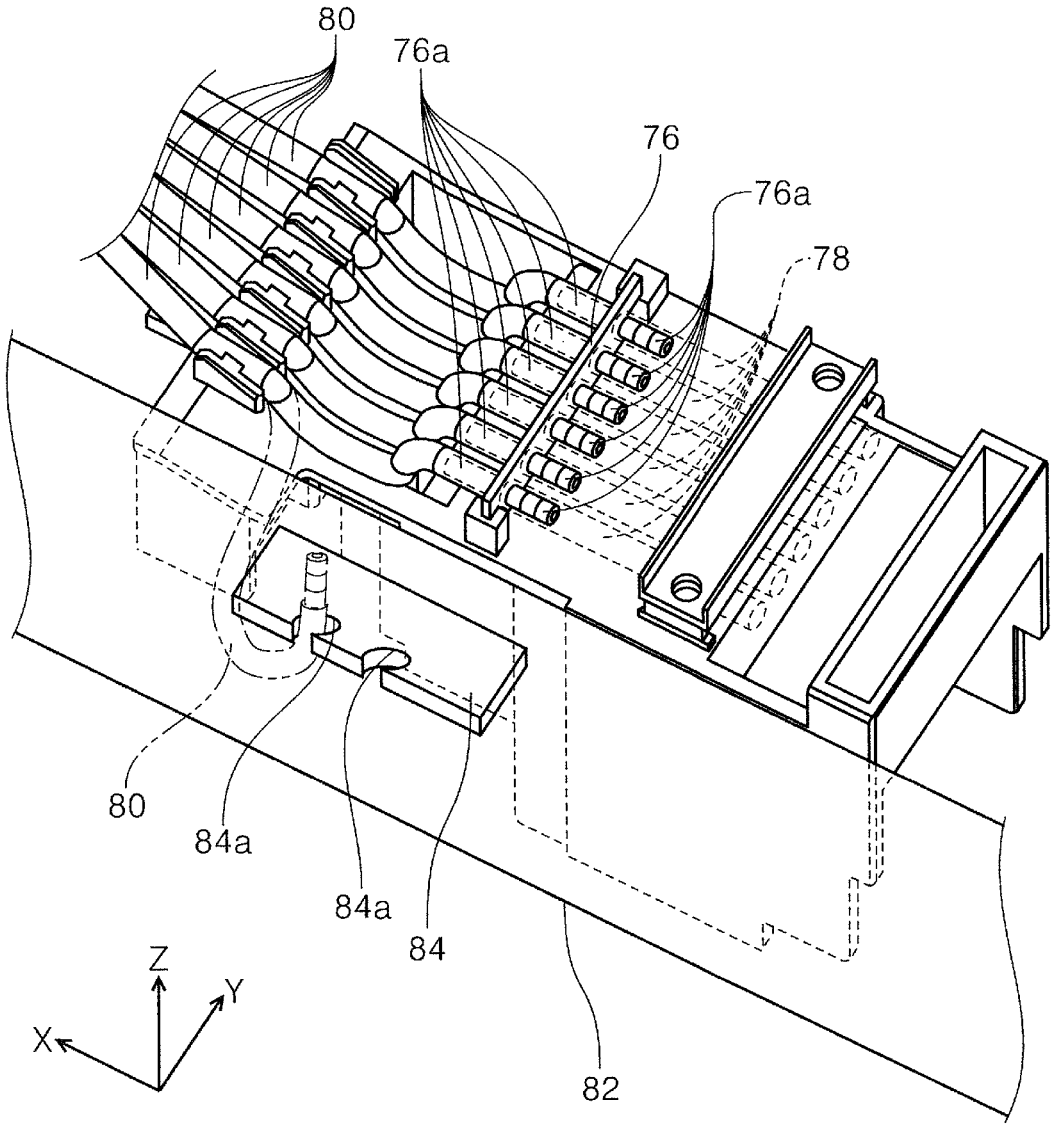
FIG. 17 is a perspective view illustrating a state in which an ink tube is held in the holding portion in the second example.
Figure 18:
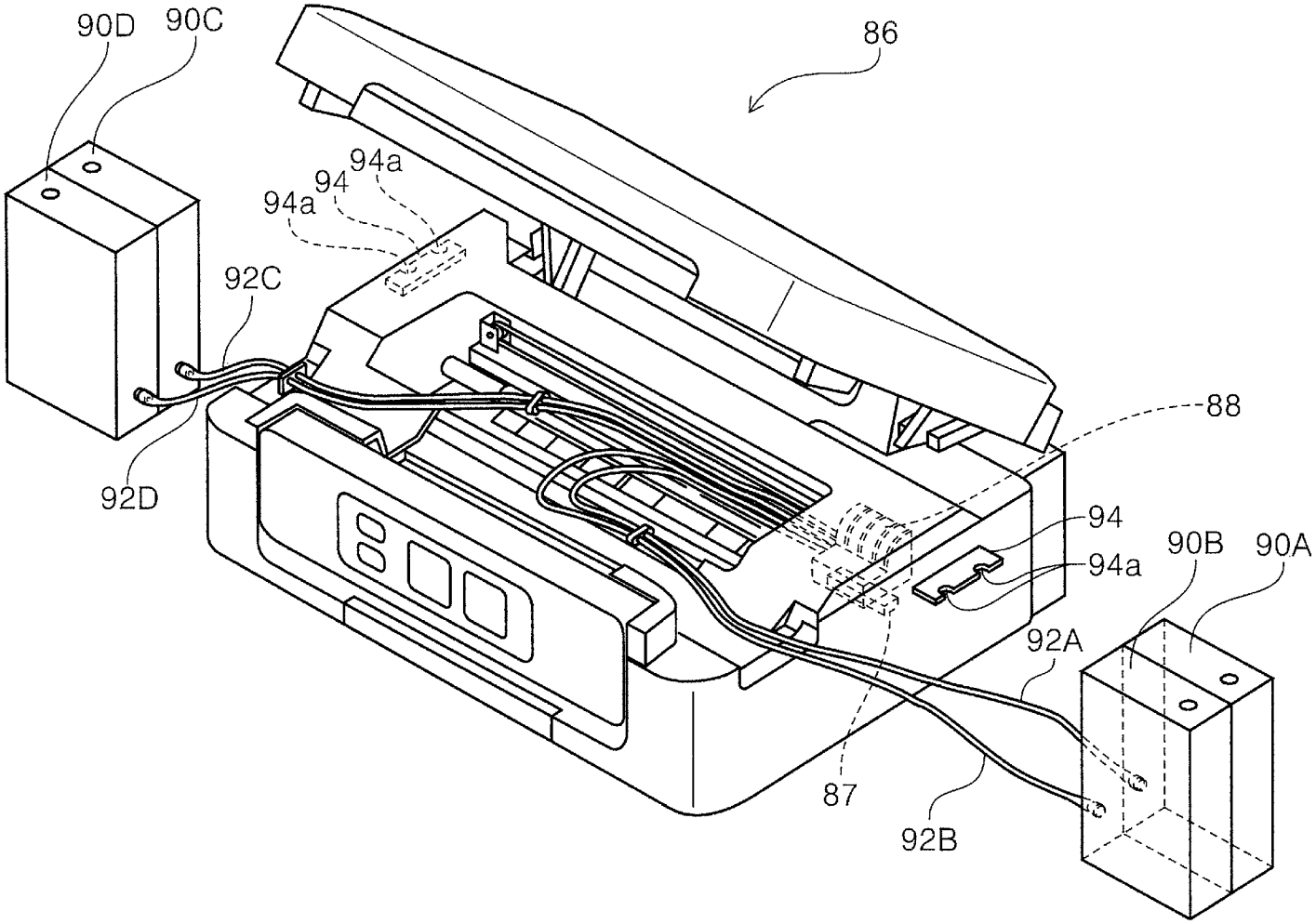
FIG. 18 is a perspective view illustrating a holding portion in a third example.
Figure 19:
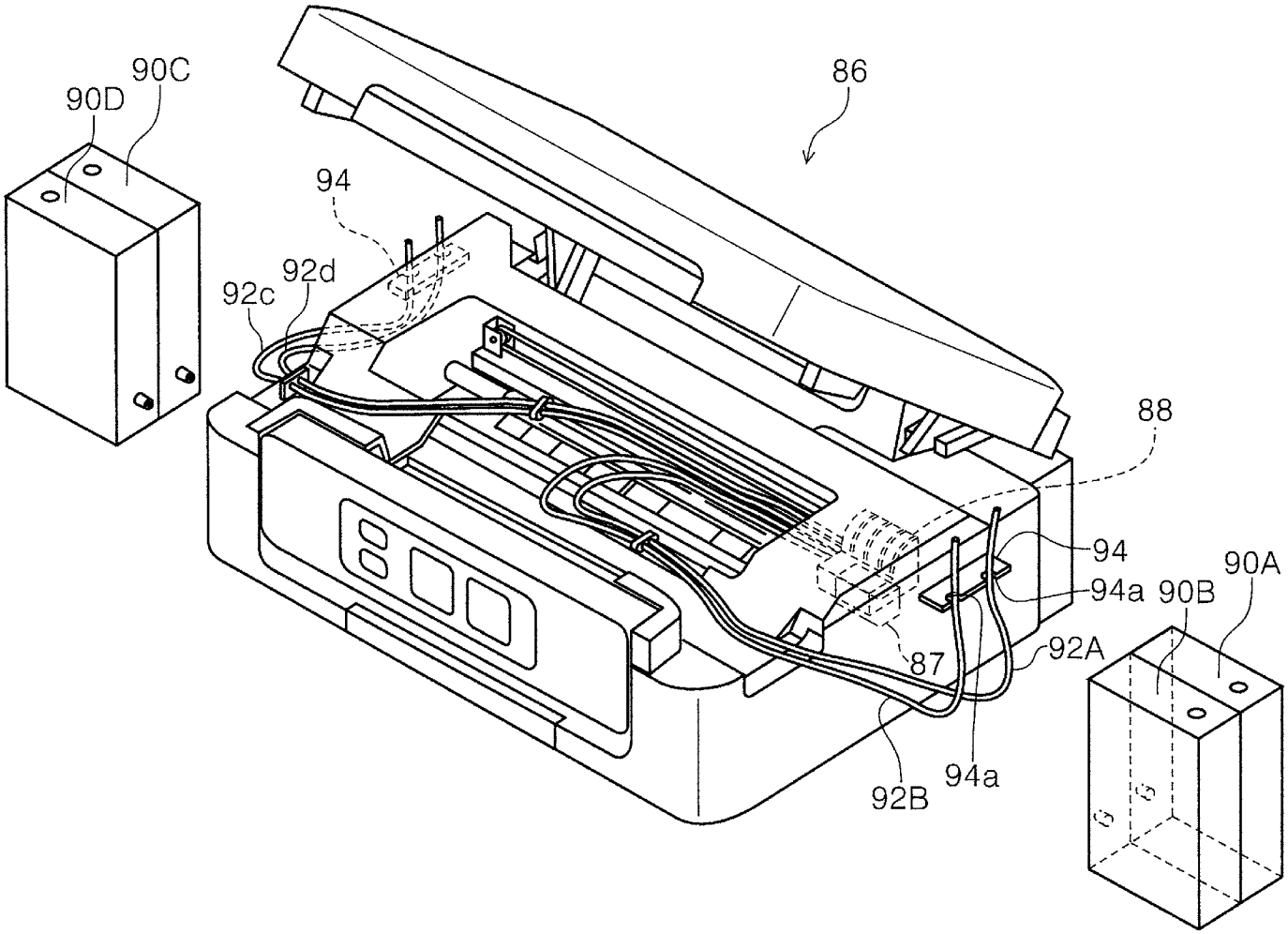
FIG. 19 is a perspective view illustrating a state in which an ink tube is held in the holding portion in the third example.

In addition, FIG. 13 is a perspective view of a state in which one-touch clamps that are provided in the holding portion are open, FIG. 14 is a perspective view illustrating a state in which the ink tube is held in the holding portion, FIG. 15 is a perspective view illustrating a state in which the ink tube is held in the ink accommodating body storage portion, FIG. 16 is a perspective view illustrating a holding portion in a second example, FIG. 17 is a perspective view illustrating a state in which an ink tube is held in the holding portion in the second example, FIG. 18 is a perspective view illustrating a holding portion in a third example, and FIG. 19 is a perspective view illustrating a state in which an ink tube is held in the holding portion in the third example.

In addition, in a X-Y-Z coordinate system indicated in each drawing, an X direction is a direction in which a document is fed in a feeding mechanism portion of a scanner portion and indicates a width direction of the recording apparatus, a Y direction is a main scanning direction in a reading mechanism portion and indicates a depth direction of the recording apparatus, and a Z direction indicates an apparatus height direction. Note that, in each drawing, a +X direction side is the apparatus left side, a −X direction side is the apparatus right side, a −Y direction side is the apparatus front surface side, a +Y direction side is the apparatus rear surface side, a +Z direction side is the apparatus upward side, and a −Z direction side is the apparatus downward side.

Description of First Example

Summary of Printer

With reference to FIG. 1, a printer 10 as a "recording apparatus" according to the example is provided with a recording mechanism portion 12 that configures the apparatus main body, a scanner portion 14 that is disposed above the recording mechanism portion 12 and is able to rotate with respect to the recording mechanism portion 12, and ink accommodating body storage portions 16A and 16B that are respectively disposed on a right side surface and a left side surface in the apparatus width direction of the recording mechanism portion 12.

The recording mechanism portion 12 is provided with a medium accommodating portion 18 that accommodates a recording medium on a lower portion. In addition, a discharge port 20 is provided on a front surface side of the recording mechanism portion 12. Then, a discharge tray 22 that receives the recording medium which is discharged from the discharge port 20 is provided on the upper portion of the medium accommodating portion 18.

In addition, an operation portion 24 is provided above the discharge port 20 on the apparatus front surface side. Then, a carriage 26 (refer to broken line portion of FIG. 1 and FIG. 3) as a "unit body" is configured to be able to reciprocate along the apparatus width direction by driving means that is not illustrated inside the recording mechanism portion 12. A recording head 28 (refer to broken line portion of FIG. 1 and FIG. 6) that discharges ink toward the recording medium is provided on a lower portion of the carriage 26.

In the example, a recording medium that is accommodated in the medium accommodating portion 18 is fed to a region that faces the recording head 28 of the carriage 26 using feeding means which is not shown in the drawings. Then, recording is executed by the recording medium receiving ink that is discharged from the recording head 28 in a region that faces the recording head 28. Then, the recording medium on which recording is executed is discharged toward the discharge tray 22.

Summary of Scanner Portion

Next a summary of a scanner portion 14 will be described. The scanner portion 14 is provided with a reading mechanism portion 14*b* that is provided with a document stand 14*a* (refer to the broken line portion in FIG. 1) that mounts a document on an upper surface, and a feeding mechanism portion 14*c* that is able to switch between a closed posture (state in which a reference numeral 14*c* is given in FIG. 1) and an open posture (state in which a reference numeral 14*c*' is given in FIG. 1) with respect to the reading mechanism portion 14*b*. The feeding mechanism portion 14*c* in the example is configured to be able to rotate an end portion on the apparatus rear surface side with respect to the reading mechanism portion 14*b* as a rotation support point.

Then, it is possible to set the document on the document stand 14*a* (refer to the broken line portion in FIG. 1) by setting the feeding mechanism portion 14*c* to the open posture (state of reference numeral 14*c*' in FIG. 1) with respect to the reading mechanism portion 14*b*. In addition, reading means (not illustrated) which is able to read a reading surface of the document that is set in the document stand 14*a* is provided within the reading mechanism portion 14*b*. In addition, the feeding mechanism portion 14*c* is configured to be able to transport the document that is set in a document setting portion 14*d* toward a document discharge tray 14*e*, and is configured to be able to read the reading surface of the document using the reading means during transport of the document.

Regarding Flow Path of Printer Ink

With reference to FIGS. 2 and 3, ink accommodating body storage portions 16A and 16B are respectively disposed on both side surfaces of the recording mechanism portion 12 in the apparatus width direction. In the ink accommodating body storage portions 16A and 16B, ink as "liquid" is accommodated, and an ink accommodating body 30 as a "liquid accommodating portion" (refer to FIG. 8) is stored. In detail, the ink accommodating body 30 (refer to FIG. 8) that accommodates black ink is stored in the ink accommodating body storage portion 16A which is provided on the left side surface of the recording mechanism portion 12 in FIG. 2. Note that, the ink accommodating body 30 in the example is configured, for example, as a sealed bag shape pack member.

In addition, although not shown in the drawings, the ink accommodating body 30 that accommodates, for example, each color ink of magenta, yellow, and cyan is stored in the ink accommodating body storage portion 16B which is provided on the right side surface of the recording mechanism portion 12 in FIG. 2.

In the example, the carriage 26 that is provided with the recording head 28 and a relay portion 32 are provided inside the recording mechanism portion 12. An ink flow path 34 as a "liquid flow path" in the printer 10 will be described with reference to FIG. 3. The ink flow path 34 in the example is configured as a flow path that supplies ink to the recording head 28 which is provided on a bottom portion of the carriage 26 via the relay portion 32 from the ink accommodating body 30 (not illustrated in FIG. 3) that is accommodated within the ink accommodating body storage portion 16A and the ink accommodating body 30 that is accommodated within the ink accommodating body storage portion 16B.

Furthermore, the ink flow path 34 will be described with reference to FIGS. 4 to 11. As shown in FIGS. 4 to 6, the carriage 26 is formed in a box shape in which an apparatus height direction upward side is open. Then, an ink tube connecting portion 36 (refer to FIG. 5) for supplying ink to the recording head 28 is attached within the box-shaped carriage 26 by a fastening member (not illustrated) such as a screw. As shown in FIG. 6, the recording head 28 is attached to the carriage 26 on the apparatus height direction downward side of the ink tube connecting portion 36.

In addition, one end of the ink tube 38 as a "tube" is attached to the ink tube connecting portion 36. The ink tube 38 in the example forms a number of ink tubes that correspond to the number of ink colors that are supplied to the recording head 28 together in parallel. Then, the ink tube 38 extends from the ink tube connecting portion 36 as shown in FIGS. 3 and 4 toward the relay portion 32 while being curved inverted to the apparatus height direction upward side, and another end portion is connected to the relay portion 32.

Here, the plurality of ink tubes that configure the ink tube 38 are formed using a flexible material, and are able to configure follow up deformation accompanying movement in the apparatus width direction of the carriage 26.

Regarding Relay Portion

With reference to FIGS. 3 and 7, the relay portion 32 is configured in a box shape that is open to the apparatus depth direction front surface side. A connecting portion 32*a* that is connected to the other end portion of the ink tube 38 is provided on the apparatus width direction right side surface of the relay portion 32. In the example, a check valve that is not illustrated is provided in the connecting portion 32*a*. In addition, the relay portion 32 in the example is attached to be attachable and detachable with respect to the recording mechanism portion 12 during maintenance work in the recording mechanism portion 12.

In addition, a connector connecting portion 40 is provided in the depth direction of an opening portion 32*b* in the box-shaped relay portion 32. A plurality of connector connection ports 42 are provided in the connector connecting portion 40. Note that, the connector connection port 42 is provided to correspond to the number of colors of ink that are supplied to the recording head 28. In the example, four connector connection ports 42 are provided, and respectively correspond to each color of black, magenta, yellow, and cyan. Note that, illustration of the connector connection port 42 that corresponds to black ink is omitted in FIG. 7.

In addition, in the example, pump means that is not illustrated is provided on the rear surface side of the relay portion 32. In the example, for example, a diaphragm pump is provided with respect to each connector connection port 42.

Then, in each connector connection port 42 of the relay portion 32, black ink is supplied through an ink tube 44A as the "tube" extending from the ink accommodating body storage portion 16A, and each ink of magenta, yellow, and cyan is supplied through ink tubes 44B, 44C, and 44D as the "tubes" extending from the ink accommodating body storage portion 16B.

In addition, in each ink tube 44A, 44B, 44C, or 44D, an attachable and detachable adapter 46 as shown in FIG. 14 is attached on the end portion at a side that is connected to the connector connection port 42. In the example, the attachable and detachable adapter 46 and the connector connection port 42 are configured to be locked by the attachable and the detachable adapter 46 of each ink tube 44A, 44B, 44C, 44D being inserted into the connector connection port 42 and the attachable and the detachable adapter 46 being twisted. Note that, a flange portion 46*a* that has a larger diameter dimension than the diameter dimension of the ink tube as shown in FIG. 14 is provided on the attachable and the detachable adapter 46.

With reference to FIGS. 8 and 9, the ink accommodating body storage portion 16A is attached with respect to the recording mechanism portion 12 in a state in which an external member 48 is interposed between the recording mechanism portion 12 and the ink accommodating body storage portion 16A. In the example, the external member 48 configures at least a part of the outer appearance of the apparatus width direction left side surface of the recording mechanism portion 12.

A connecting portion 50 that is attachable and detachable to the ink accommodating body 30 is provided in the ink accommodating body storage portion 16A. The ink accommodating body 30 is configured to be able to feed accommodated ink to the outside of the ink accommodating body 30 in a state of being connected to the connecting portion 50. In addition, a check valve that is not illustrated is also provided in the connecting portion 50.

In addition, a rib 68 that guides the ink tube 44 is provided on the ink accommodating body storage portion 16A as shown in FIGS. 9 and 15. Then, the ink tube 44A is connected to the connecting portion 50. The ink tube 44A extends to the apparatus depth direction front surface side after extending to the downward side of the connecting portion 50 as shown in FIG. 9. Then, the ink tube 44A extends to the apparatus height direction upward side by guiding to the rib 68, exits outside the ink accommodating body storage portion 16A from an opening portion 52 that is provided in the ink accommodating body storage portion 16A, and is drawn into the recording mechanism portion 12. Then, the ink tube 44A is connected to the relay portion 32 as shown in FIG. 7.

Note that, the ink accommodating body storage portion 16A in the example is configured to be able to detach the ink accommodating body storage portion 16A from the recording mechanism portion 12 by removing the ink tube 44A from the relay portion 32.

Next, an ink transport path from the ink accommodating body storage portion 16B up to the relay portion 32 will be described with reference to FIGS. 10 and 11. The ink accommodating body storage portion 16B is attached with respect to the recording mechanism portion 12 in a state in which an external member 54 is interposed between the recording mechanism portion 12 and the ink accommodating body storage portion 16B. In the example, the external member 54 configures at least a part of the outer appearance of the apparatus width direction right side surface of the recording mechanism portion 12.

As shown in FIG. 10, a plurality of connecting portions 56A, 56B, and 56C are provided on the ink accommodating body storage portion 16B. In the example, the connecting portions 56A, 56B, and 56C respectively correspond to ink of each color of magenta, yellow, and cyan. Then, the connecting portions 56A, 56B, and 56C are configured to be able to respectively attach and detach the ink accommodating body 30 that accommodates ink of each color of magenta, yellow, and cyan. Note that, the check valve that is not illustrated is provided in the connecting portions 56A, 56B, and 56C.

One end of the respective ink tubes 58A, 58B, and 58C are connected to the connecting portions 56A, 56B, and 56C. Then, the attachable and the detachable adapter 46 is provided on other ends of the ink tubes 58A, 58B, and 58C. The other ends of the ink tubes 58A, 58B, and 58C are connected to be respectively attachable and detachable with respect to a relay portion 60 that is positioned on the apparatus depth direction front surface side within the ink accommodating body storage portion 16B via the attachable and the detachable adapter 46.

The relay portion 60 is provided on the recording mechanism portion 12 as shown in FIG. 11, and protrudes from the recording mechanism portion 12 to the apparatus width direction right side. Then, the relay portion 60 protrudes inside the ink accommodating body storage portion 16B by omitting an opening portion 54*a* that is provided in the external member 54 and an opening portion 62 that is provided in the ink accommodating body storage portion 16B.

In addition, the ink tubes 44B, 44C, and 44D are attached to be attachable and detachable with respect to the relay portion 60 as shown in FIG. 3. Note that, the ink accommodating body storage portion 16B in the example is configured to be able to detach the ink accommodating body storage portion 16B from the recording mechanism portion 12 by removing the other end of the ink tubes 58A, 58B, and 58C from the relay portion 60.

Regarding Holding Portion

Next, a holding portion 64 that temporarily places the ink tube will be described with reference to FIGS. 12 to 14. In the example, the holding portion 64 is provided on the apparatus depth direction front surface side of the recording mechanism portion 12 as shown in FIGS. 2 and 12. In further detail, the holding portion 64 is provided at a position that corresponds to the relay portion 32 in the apparatus width direction. In addition, the holding portion 64 is disposed further on the downward side than the relay portion 32 in the apparatus height direction.

By configuring in this manner, for example, during maintenance work of the recording mechanism portion 12, it is possible to prevent interference of the relay portion 32 and the holding portion 64 and it is possible to easily detach the relay portion 32 when at least one of the relay portion 32 and the path that supplies ink from the relay portion 32 up to the ink tube connecting portion 36 are detached from the recording mechanism portion 12 and replaced.

In the example, a plurality of one-touch clamps 66A and 66B are provided in the holding portion 64 as shown in FIG. 12. In the example, the one-touch clamps 66A and 66B use a commercial product that is configured by a resin material and the like. The one-touch clamps 66A and 66B are configured to be switchable in a simple operation between the closed state indicated in FIG. 12 and the open state indicated in FIG. 13. Then, a tube part of the ink tubes 44A, 44B, 44C, and 44D that is detached from the connector connecting portion 40 of the relay portion 32 within the one-touch clamps 66A and 66B in the open state is placed inside, and the one-touch clamps 66A and 66B are closed.

As shown in FIG. 14, when the one-touch clamp 66A is switched to the closed state and a hand is separated from the ink tube 44A, the flange portion 46*a* of the attachable and detachable adapter 46 that is provided on the tip end of the ink tube 44A is supported on the one-touch clamp 66A. That is, the ink tube 44A holds the opening of the ink tube 44A upward in the apparatus height direction using the one-touch clamp 66A, and thus the holding portion 64. Thereby, it is possible to reduce dripping down of ink within the tube from the opening of the ink tube 44A.

Note that, the size of the opening portion of the one-touch clamp 66 in the example is set to be larger than the outer diameter dimension of the ink tube 44 and smaller than the outer diameter dimension of the flange portion 46*a* of the attachable and detachable adapter 46.

Note that, in FIG. 14, although only the ink tube 44A that is supported in the one-touch clamp 66A is illustrated, the one-touch clamp 66B in the example is configured to be able to hold the relay portion 32 or the ink tubes 44B, 44C, and 44D that are detached from the relay portion 60.

In addition, with reference to FIG. 15, when the ink accommodating body storage portion 16A is detached from the recording mechanism portion 12, it is possible to hold the ink tube 44A that is detached from the relay portion 32 fitted to the rib 68. That is, the rib 68 functions as the holding portion of the ink tube 44A. Thereby, there is no need to provide a configuration in which the ink tube 44A is held separately within the ink accommodating body storage portion 16A, and it is possible to simplify the configuration of the ink accommodating body storage portion 16A.

Modification Example of First Example (1) In the example, there is a configuration in which the feeding mechanism portion 14*c* is provided in the scanner portion 14, but in addition to this configuration, a cover member may be provided.

(2) In the example, there is a configuration in which the ink tubes 44B, 44C, and 44D are held in the one-touch clamp 66B of the holding portion 64, but in addition to this configuration, the one-touch clamp 66A is provided with only the number of ink tubes, and there may be a configuration in which the respective ink tubes 44A, 44B, 44C, and 44D are individually held.

(3) In the example, in the ink accommodating body storage portion 16B, the holding portion that holds the ink tubes 58A, 58B, and 58C that are detached from the relay portion 60 is not provided, but in addition to this configuration, there may be a configuration in which the holding portion within the ink accommodating body storage portion 16B is provided at one location or a plurality of places that correspond to the number of ink tubes.

(4) In addition, there may be a configuration in which the ink tube connecting portion 36 and the ink tube 38 that are detached from the carriage 26 are held by the holding portion 64.

(5) In addition, in the example, there is a configuration in which the holding portion 64 holds the ink tube with commercially available one-touch clamps 66A and 66B, but in addition to this configuration, for example, there may be a configuration in which the ink tube hangs down using a hook or a clip, or a configuration in which the attachable and detachable adapter 46 and an attachable and detachable adapter connection port is provided in the holding portion 64.

(6) In the example, the holding portion 64 is provided at a position that corresponds to the relay portion 32, but in addition to this configuration, there may be a configuration in which the holding portion 64 is provided at a position that does not interfere with attachment and detachment of the relay portion 32 during maintenance work in the recording mechanism portion 12. In addition, there may be a configuration in which it is possible to store the holding portion 64 with respect to the recording mechanism portion 12, for example, a door type, a pull-out type, a removable type, and the like.

(7) In the example, the carriage 26 is configured as a serial type carriage, but in addition to this configuration, the carriage 26 may be configured as a line type carriage.

(8) In the example, there is a configuration in which the ink tubes 44B, 44C, and 44D are held in the one-touch clamp 66B of the holding portion 64, but in addition to this configuration, there may be a configuration in which a multiple tube in which the ink tubes 44B, 44C, and 44D are integrated is held in the one-touch clamp 66B, and there may be a configuration in which the attachable and detachable adapter 46 that is attached to the tip end of the respective ink tubes 44B, 44C, and 44D is integrated and the integrated attachable and detachable adapter 46 is held in the one-touch clamp 66B. It is possible to improve workability of maintenance using such a configuration.

(9) In the example, there is a configuration in which the check valve is not provided in the attachable and detachable adapter 46 which is provided on the tip end of the ink tubes 44A, 44B, 44C, and 44D, but in addition to this configuration, the check valve may be provided in the attachable and detachable adapter 46. When the ink tube 44 is detached from the connector connection port 42 by providing the check valve in the attachable and detachable adapter 46, it is possible to further reliably prevent ink within the ink tube 44 from leaking out. However, when the attachable and detachable adapter 46 of the ink tube 44A is detached from the connector connection port 42 of the relay portion 32, ink of one or two droplets may be adhered to the attachable and detachable adapter 46. In this manner, even in a case where ink of one or two droplets is adhered to the attachable and detachable adapter 46, since the holding portion 64 holds the attachable and detachable adapter 46 upward in the apparatus height direction, it is possible to reduce dripping down of adhered ink droplets.

Description of Second Example

Next, a printer 70 according to a second example will be described with reference to FIGS. 16 and 17. The printer 70 is provided with a carriage 72 that is provided with the recording head which is not illustrated. In the printer 70, the carriage 72 is configured to be able to reciprocate along the apparatus width direction (X axis direction) in FIG. 16. A plurality of ink accommodating portions 74 are provided as the "liquid accommodating portion" on the right side surface of the printer 70. In the example, the ink accommodating portion 74 is configured as a large capacity ink tank. Then, in the example, the ink accommodating portion 74 is configured such that it is possible to replenish ink.

Within the printer 70, in a case where the carriage 72 is positioned at a home position (position of the carriage 72 in FIG. 16), a relay portion 76 (refer to FIG. 17) is provided on the apparatus depth direction front surface side of the carriage 72. In the example, the relay portion 76 is configured to provide a plurality of pipe joints 76*a* for feeding ink from the ink accommodating portion 74 to the carriage 72. In addition, the respective check valves (not illustrated) are provided on the pipe joints 76*a* of the relay portion 76.

In the example, the ink accommodating portion 74 and the relay portion 76 are connected by a plurality of ink tubes 78. Then, the relay portion 76, the carriage 72, and thus the recording head (not illustrated) are connected by a plurality of ink tubes 80. That is, in the example, an ink path from the ink accommodating portion 74 up to the carriage 72 is configured by the ink tube 78, the relay portion 76, and ink tubes 80.

In addition, a holding portion 84 is provided on a frame 82 that extends in the apparatus width direction and is positioned at the apparatus depth direction front surface side of the relay portion 76. A plurality of concave portions 84*a*, which hold the ink tube 78, and thus the ink tubes 80 that are attachably and detachably fitted, are provided on the holding portion 84. Then, the holding portion 84 is able to hold the ink tube 78, and thus the opening portion of the end portion of the ink tubes 80 in a posture upward in the apparatus height direction by fitting an ink tube 78 that is separated from the relay portion 76, and thus a part of the ink tubes 80 in the concave portion 84*a* using the one-touch clamps 66A and 66B (refer to FIG. 17).

Note that, in the example, the ink accommodating portion 74 is configured to be open to the atmosphere. Then, when the ink tube 78 that is detached from the relay portion 76 is held in the holding portion 84, a height in the apparatus height direction of the opening portion of the end portion of the ink tube 78 is set to be higher than a liquid surface of ink that is accommodated in the ink accommodating portion 74. Thereby, it is possible to prevent ink that is accommodated in the ink accommodating portion 74 leaking out from the opening portion of the ink tube 78 due to a siphon effect. Then, by configuring in this manner, it is possible to easily replace or repair the ink accommodating portion 74 in the printer 70.

Modification Example of Second Example (1) In the example, there is a configuration in which, for example, the concave portion 84*a* is provided at two locations in the holding portion 84, but in addition to this configuration, there may be a configuration in which the concave portions 84*a* are provided to correspond to the number of ink tubes 78 and 80.

(2) In the example, there is a configuration in which the holding portion 84 is provided with the frame 82, but in addition to this configuration, there may be a configuration in which the holding portion 84 is provided at an arbitrary location of the printer 70 within a range reaching the ink tube 78 or the ink tube 80.

Description of Third Example

Next, a printer 86 according to a third example will be described with reference to FIGS. 18 and 19. The printer 86 is provided with a carriage 88 that is provided with a recording head 87. In the printer 86, the carriage 88 is configured to be able to reciprocate along the apparatus width direction (X axis direction) in FIG. 18. A plurality of ink accommodating portions 90A, 90B, 90C, and 90D are provided as the "liquid accommodating portions" in a region outside of the printer 86. In the example, the ink accommodating portions 90A, 90B, 90C, and 90D are configured as respective large capacity ink tanks. In the example, the ink accommodating portion 90 is configured such that it is possible to replenish respective ink.

In the example, the carriage 88 and the ink accommodating portions 90A, 90B, 90C, and 90D are connected to be able to supply ink from the ink accommodating portions 90A, 90B, 90C, and 90D to the carriage 88, and thus the recording head 87 using the ink tubes 92A, 92B, 92C, and 92D. Note that, in the example, the discharge port is provided on the lower portion of the ink accommodating portions 90A, 90B, 90C, and 90D, and the discharge port is inserted in the opening portion of the end portions of the ink tubes 92A, 92B, 92C, and 92D.

In addition, the holding portions 94 and 94 are respectively provided on the apparatus width direction both end surfaces, that is, the right side surface and the left side surface of the printer 86 in the example. A plurality of concave portions 94*a*, which hold the ink tube 92 to be attachably and detachably fitted, are provided on the holding portion 94. In the example, two concave portions 94*a* are provided in the holding portion 94.

Then, as shown in FIG. 19, the ink tubes 92A, 92B, 92C, and 92D are detached from the ink accommodating portions 90A, 90B, 90C, and 90D, and a part of the ink tubes 92A, 92B, 92C, and 92D are fitted into the concave portion 94*a* of the holding portion 94. Thereby, the holding portion 94 is able to hold the ink tubes 92A, 92B, 92C, and 92D while the opening portion of the end portions of the ink tubes 92A, 92B, 92C, and 92D faces the apparatus height direction upper side. Then, by configuring in this manner, it is possible to easily replace or repair the ink accommodating portions 90A, 90B, 90C, and 90D in the printer 86.

Modification Example of Third Example (1) In the example, the ink accommodating portions 90A, 90B, 90C, and 90D are configured to be provided in a region outside of the printer 86, but in addition to this configuration, there may be a configuration in which the ink accommodating portions 90A, 90B, 90C, and 90D are attached to be attachable and detachable in the printer 86 on the apparatus rear surface, the apparatus right side surface, and the apparatus left side surface.

(2) In the example, there is a configuration in which the holding portion 94 is provided on the apparatus right side surface and the apparatus left side surface, but in addition to this configuration, there may be a configuration in which the holding portion 94 is provided at an arbitrary location of the printer 86 within a range reaching the ink tubes 92A, 92B, 92C, and 92D.

Summarizing the description, the printer 10 is provided with the recording head 28 that ejects ink onto the recording medium, the ink accommodating body 30 that accommodates ink, the relay portion 32 that is provided on the ink flow path 34 between the ink accommodating body 30 and the recording head 28 and relays ink, the ink tubes 44A, 44B, 44C, and 44D that form at least a part of the ink flow path 34 between the ink accommodating body 30 and the relay portion 32 and are attachable and detachable with respect to the relay portion 32, and the holding portion 64 that holds the ink tubes 44A, 44B, 44C, and 44D in a state of being detached from the relay portion 32.

According to the configuration, since the printer 10 is provided with the relay portion 32 that is provided on the ink flow path 34 between the ink accommodating body 30 and the recording head 28 and relays the ink, and is provided with the holding portion 64 that holds the ink tubes 44A, 44B, 44C, and 44D in a state of being detached from the relay portion 32, it is possible to hold the ink tubes 44A, 44B, 44C, and 44D that are detached from the relay portion 32 with easy workability.

Summarizing the description, the printer 86 is provided with the recording head 28 that ejects ink onto the recording medium, the ink accommodating portions 90A, 90B, 90C, and 90D that accommodate ink, the ink tubes 92A, 92B, 92C, and 92D that form at least a part of the ink flow path between the ink accommodating portions 90A, 90B, 90C, and 90D and the recording head 87 and are attachable and detachable with respect to the ink accommodating portions 90A, 90B, 90C, and 90D, and the holding portion 94 that holds the ink tubes 92A, 92B, 92C, and 92D in a state of being detached from the ink accommodating portions 90A, 90B, 90C, and 90D.

According to the configuration, since the printer 86 is provided with the holding portion 94 which holds the ink tubes 92A, 92B, 92C, and 92D in a state of being detached from the ink accommodating portions 90A, 90B, 90C, and 90D that accommodate ink, it is possible to hold the ink tubes 92A, 92B, 92C, and 92D that are detached from the ink accommodating portions 90A, 90B, 90C, and 90D with easy workability.

The printer 10 is provided with the carriage 26 which provides the recording head 28 that ejects ink onto the recording medium, the ink accommodating body 30 that accommodates ink, the ink tube 38 that forms at least a part of the ink flow path 34 between the ink accommodating body 30 and the recording head 28 and is attachable and detachable with respect to the carriage 26, and the holding portion 64 that holds the ink tube 38 in a state of being detached from the carriage 26.

According to the configuration, since the printer 10 is provided with the carriage 26 that is provided with the recording head 28 that ejects ink onto the recording medium, and is provided with the holding portion 64 that holds the ink tube 38 in a state of being detached from the carriage 26, it is possible to hold the ink tube 38 that is detached from the carriage 26 with easy workability.

The holding portions 64, 84, and 94 hold the ink tubes 38, 44, 58, 78, 80, and 92 in a state in which the opening of the ink tubes 38, 44, 58, 78, 80, and 92 is upward. According to the configuration, since the holding portions 64, 84, and 94 hold the ink tubes 38, 44, 58, 78, 80, and 92 in the state in which the opening of the ink tubes 38, 44, 58, 78, 80, and 92 is upward, it is possible to more reliably prevent leakage of ink from the opening of the ink tubes 38, 44, 58, 78, 80, and 92.

There is a configuration in which the ink accommodating body 30, the ink accommodating portions 74 and 90, and the ink tubes 38, 44, 58, 78, 80, and 92 are provided for each ink of a plurality of colors, and the holding portions 64, 84, and 94 hold each of the plurality of ink tubes 38, 44, 58, 78, 80, and 92.

According to the configuration, since there is a configuration in which the ink accommodating body 30, the ink accommodating portions 74 and 90, and the ink tubes 38, 44, 58, 78, 80, and 92 are provided for each ink of a plurality of colors, and the holding portions 64, 84, and 94 hold each of the plurality of ink tubes 38, 44, 58, 78, 80, and 92, operation is easy in which the ink tubes 38, 44, 58, 78, 80, and 92 are held in the holding portions 64, 84, and 94 in comparison to the configuration in which the plurality of ink tubes 38, 44, 58, 78, 80, and 92 are held together, it is possible to hold only arbitrary ink tubes 38, 44, 58, 78, 80, and 92, and the degree of freedom of maintenance work or repair work of the printers 10, 70, and 86 improves.

The opening ends of the ink tubes 44A, 44B, 44C, and 44D are configured by the attachable and detachable adapter 46 that has a flange portion 46*a* which is larger than the diameter of the ink tubes 44A, 44B, 44C, and 44D, and the holding portion 64 is configured to lock the attachable and detachable adapter 46 using the flange portion 46*a*.

According to the configuration, since the opening ends of the ink tubes 44A, 44B, 44C, and 44D are configured by the attachable and detachable adapter 46 that has the flange portion 46*a* which is larger than the diameter of the ink tubes 44A, 44B, 44C, and 44D, and the holding portion 64 is configured to lock the attachable and detachable adapter 46 using the flange portion 46*a*, it is possible to reliably hold the ink tubes 44A, 44B, 44C, and 44D while simplifying the structure of the holding portion 64.

The holding portion 64 is configured by the one-touch clamps 66A and 66B. According to the configuration, it is possible to hold the ink tubes 44A, 44B, 44C, and 44D are held in the holding portion 64 with easier workability.

The relay portion 32 is configured to be attachable and detachable, and in a state in which the holding portion 64 holds the ink tubes 44A, 44B, 44C, and 44D, the holding portion 64 and the ink tubes 44A, 44B, 44C, and 44D are positioned at a location which is apart from the attachment and detachment region of the relay portion 32.

According to the configuration, since the relay portion 32 is configured to be attachable and detachable, and in a state in which the holding portion 64 holds the ink tubes 44A, 44B, 44C, and 44D, the holding portion 64 and the ink tubes 44A, 44B, 44C, and 44D are positioned at the location which is apart from the attachment and detachment region of the relay portion 32, it is possible to attach and detach the relay portion 32 with easy workability without the holding portion 64 and the ink tubes 44A, 44B, 44C, and 44D being obstacles during the attachment and detachment work of the relay portion 32.

The relay portion 32 is provided with the check valve that stops leakage of ink from the connector connecting portion 40 that connects the ink tubes 44A, 44B, 44C, and 44D. According to the configuration, it is possible to prevent leakage of liquid from the connector connecting portion 40 when the ink tubes 44A, 44B, 44C, and 44D are detached from the relay portion 32.

The printer 10 is provided with the ink accommodating body storage portion 16A that stores the ink accommodating body 30, and the rib 68 that functions as the holding portion is provided inside the ink accommodating body storage portion 16A.

In addition, in the embodiment, the holding portions 64, 84, and 94 according to the invention are applied in the ink jet printer as an example of the recording apparatus, but it is also possible to generally apply the invention to other liquid ejecting apparatuses.

Here, the liquid ejecting apparatus is not limited to a recording medium such as a printer, a copier, or a facsimile which uses an ink jet recording head and performs recording on the recording medium by discharging ink from the recording head, and includes an apparatus which adheres liquid to the recording medium by ejecting the liquid that corresponds to use in place of ink onto the recording medium which is equivalent to the recording medium from a liquid ejecting head that is equivalent to the ink jet recording head.

As the liquid ejecting head, in addition to the recording head, there are examples of a color material ejecting head which is used for manufacturing a color filter for a liquid crystal display or the like, an electrode material (conductive paste) ejecting head which is used for forming electrodes such as an organic EL display or a field emission display (FED), a biological organic matter ejecting head which is used for manufacturing biochips, a sample ejecting head as a precision pipette, and the like.

Note that, the invention is not limited to the examples described above, and various modifications are possible within the scope of the invention described in the claims and it is needless to say that the modifications are included in the scope of the invention.

What is claimed is:

1. A recording apparatus comprising:

a recording head that ejects liquid onto a recording medium;

a liquid accommodating portion that accommodates the liquid;

a relay portion that is provided on a flow path of the liquid between the liquid accommodating portion and the recording head and relays the liquid;

a tube that forms at least a part of the flow path of the liquid between the liquid accommodating portion and the relay portion and is attachable and detachable with respect to the relay portion; and a holding portion that holds the tube in a state of being detached from the relay portion, wherein the holding portion is positioned below the recording head with respect to a height direction of the recording apparatus.

2. A recording apparatus comprising:

a recording head that ejects liquid onto a recording medium;

a liquid accommodating portion that accommodates the liquid;

a tube that forms at least a part of a flow path of the liquid between the liquid accommodating portion and the recording head and is attachable and detachable with respect to the liquid accommodating portion; and a holding portion that holds the tube in a state of being detached from the liquid accommodating portion, wherein the holding portion is positioned below the recording head with respect to a height direction of the recording apparatus.

3. A recording apparatus comprising:

a unit body which is provided with a recording head that ejects liquid onto a recording medium;

a liquid accommodating portion that accommodates the liquid;

a tube that forms at least a part of a flow path of the liquid between the liquid accommodating portion and the recording head and is attachable and detachable with respect to the unit body; and a holding portion that holds the tube in a state of being detached from the unit body, wherein the holding portion is positioned below the recording head with respect to a height direction of the recording apparatus.

4. The recording apparatus according to claim 1, wherein the holding portion holds the tube in a state in which an opening of the tube is upward.

5. The recording apparatus according to claim 1, wherein the liquid accommodating portion and the tube are provided for each liquid of a plurality of colors, and the holding portion holds each of the plurality of tubes.

6. The recording apparatus according to claim 1, wherein an opening end of the tube is configured by an attachable and detachable adapter that has a flange portion which is larger than a diameter of the tube, and the holding portion is configured to lock the attachable and detachable adapter using the flange portion.

7. The recording apparatus according to claim 6, wherein the holding portion is configured by one-touch clamps.

8. The recording apparatus according to claim 1, wherein the relay portion is configured to be attachable and detachable, and in a state in which the holding portion holds the tube, the holding portion and the tube are positioned at a location which is apart from an attachment and detachment region of the relay portion.

9. The recording apparatus according to claim 1, wherein the relay portion is provided with a check valve that stops leakage of the liquid from a connecting portion to which the tube is connected.

10. The recording apparatus according to claim 2, further comprising:

a storage portion that stores the liquid accommodating portion, wherein the holding portion is provided inside the storage portion.

11. The recording apparatus according to claim 1, wherein the holding portion includes a clamping portion configured to releasably hold the tube.

12. The recording apparatus according to claim 2, wherein the holding portion includes a clamping portion configured to releasably hold the tube.

13. The recording apparatus according to claim 3, wherein the holding portion includes a clamping portion configured to releasably hold the tube.

14. The recording apparatus according to claim 1, wherein the holding portion is positioned inside a body of the recording apparatus.

15. The recording apparatus according to claim 2, wherein the holding portion is positioned inside a body of the recording apparatus.

16. The recording apparatus according to claim 3, wherein the holding portion is positioned inside a body of the recording apparatus.

* * * * *